US006127926A

United States Patent [19]

Dando

[11] Patent Number: 6,127,926

[45] Date of Patent: Oct. 3, 2000

[54] INTRUSION SENSING SYSTEMS

[76] Inventor: David John Dando, Woodbirds Cottage, Low Ham, Langport, Somerset TA10 9DT, United Kingdom

[21] Appl. No.: 08/981,566

[22] PCT Filed: Jun. 24, 1996

[86] PCT No.: PCT/GB96/01517

§ 371 Date: Apr. 10, 1998

§ 102(e) Date: Apr. 10, 1998

[87] PCT Pub. No.: WO97/01160

PCT Pub. Date: Jan. 9, 1997

[30] Foreign Application Priority Data

Jun. 22, 1995 [GB] United Kingdom ..... 9512753

[51] Int. Cl.[7] ..... G08B 13/00

[52] U.S. Cl. ..... 340/541; 340/541; 340/565; 340/552; 340/522; 340/528; 340/553; 340/556; 340/567; 340/825.32

[58] Field of Search ..... 340/541, 565, 340/552, 522, 523, 528, 545.2, 553, 556, 567, 825.06, 825.32

[56] References Cited

U.S. PATENT DOCUMENTS

| | | | |
|---|---|---|---|
| 4,079,361 | 3/1978 | Woode | 340/552 |
| 4,191,953 | 3/1980 | Woode | 340/552 |
| 4,219,802 | 8/1980 | Ceseri | 340/552 |
| 4,752,778 | 6/1988 | Simpson | 340/552 |
| 5,276,427 | 1/1994 | Peterson | 340/522 |
| 5,475,365 | 12/1995 | Hoseit et al. | 340/522 |
| 5,684,458 | 11/1997 | Calvarese | 340/554 |
| 5,781,108 | 7/1998 | Jacob et al. | 340/552 |
| 5,786,760 | 7/1998 | Suzuki et al. | 340/541 |

FOREIGN PATENT DOCUMENTS

| | | | |
|---|---|---|---|
| 0337964 | 4/1989 | European Pat. Off. | G08B 29/00 |
| 0499177 | 1/1992 | European Pat. Off. | G08B 13/193 |
| 1475111 | 1/1974 | United Kingdom | G08B 13/24 |

OTHER PUBLICATIONS

Edward J. Foley; Reduction of Nuisance Alarms in Exterior Sensors Using E.S.P.; Oct. 13, 1993; pp. 251–253.

Jayne D. Ward and Kerrie J. Sena; Senlex: Sensor Layout Expert System; 1986 International Carnahan Conference on Security Technology, Gothenburg, Sweden, Aug. 12–14, 1986; pp. 119–124.

*Primary Examiner*—Daniel J. Wu
*Assistant Examiner*—Toan Pham
*Attorney, Agent, or Firm*—Oppenheimer Wolff & Donnelly LLP

[57] ABSTRACT

Vertical surface protection in a security installation is achieved by detecting disturbances in a microwave beam sent from a transmitter to a receiver, both installed substantially above the ground and adjacent to the vertical surface. The transmitter and receiver have associated beam aerials of extended horizontal aperture of not less than 0.50 meters (20 inches) to mitigate the effects of surface reflection from metal scaffold, plastic sheeting or netting, wooden boarding and brick or stone facing. The aerials are preferably slotted waveguide arrays and the advantages of using circular polarization are shown. Circularly-polarized slotted waveguide arrays are disclosed having a center feed to minimize frequency-dependent beam-spreading. The sensor may be used with an intruder detector to protect buildings in scaffold by utilizing triple technology exterior detection incorporating: microwave Doppler shift; at least one and preferably two passive infra-red devices linked together through timers and lens with horizontal curtain pattern; and anti-sabotage reflected active infra-red. The system can combine the aforementioned technologies into a new device and this format overcomes the individual limitations of each of the prior art technologies when used in unison in an external scaffold environment.

47 Claims, 19 Drawing Sheets

30 m 100 m 150 m

SOLAR PANELS
18
SIREN & STROBE
9
SOLAR PANELS
20
20
SOLAR PANELS
SOLAR PANELS
20
INTRUDER DETECTOR
8
CAMERA
10
INTRUSION SENSOR
7
CAMERA
10
KEYPAD
24
REPEATER
21
12
KEYPAD
22
26
CCTV CAMERA
CONTROL PANEL/ MAIN RECEIVER
15
RADIO PAGING UNIT
CELLULAR TELEPHONE DATA LINK
PRINTER
14
13
MODEM
27
FLOODLIGHT SWITCH
POWER SUPPLY
DIGITAL TELEPHONE COMMUNICATOR
23
25
16
ASSEMBLY UNIT
240/110 V. AC
17
20
SOLAR PANELS

INTRUSION SENSING SYSTEMS

BACKGROUND OF THE INVENTION

The present invention relates to intrusion sensing systems and components therefor and is particularly concerned with intrusion sensors and intruder detectors for use in protecting vertical surfaces.

SUMMARY OF THE INVENTION

By a "vertical surface" we mean a real or imaginary surface which extends with its major component of direction vertically and which itself is not necessarily a flat surface. In particular, a vertical surface may be represented by a face of a building or by an imaginary surface defined by the face of scaffolding or of a scaffolding tower. Thus a horizontal plane or surface is to include any plane extending substantially at right angles to such vertical surface.

According to one aspect of the invention there is provided an intrusion sensor comprising a microwave transmitter, with an associated microwave aerial, and a microwave receiver, with associated microwave aerial, for receiving radiation transmitted by the transmitter, the receiver having means responsive to variation of the received radiation outside a given range to produce a signal to represent the presence of an intruder, the transmitter and receiver aerials each having an aperture which has an extent, in a direction substantially at right angles to a vertical surface, of not less than 0.50 meters (20 inches) to provide a microwave beam pattern between the aerials in a substantially horizontal plane, the aerials being mounted adjacent to a vertical surface at opposite ends of a path to be monitored for intruder presence.

In a preferred embodiment, each aerial is provided by a horizontally extending array of radiating elements co-acting to provide the required horizontal beam pattern. Preferably the beam pattern has a half-power beam width not greater than 2°.

Thus, according to a second aspect of the invention there is provided an intrusion sensor comprising a microwave transmitter having a microwave aerial, and a microwave receiver having a receiving microwave aerial and which receiver includes means responsive to a variation in received signal to provide an alarm signal, each of the aerials comprising an array of radiating elements extending in a horizontal plane and co-acting to provide a substantially horizontal beam pattern having a half-power beam width not greater than 2°, the aerials being mounted spaced apart in the vicinity of a vertical surface so that each element of the receiver array receives radiation components directly from each element of the transmitter array together with vertical-surface-reflected components from at least some of the elements of the transmitter array, the direct and surface-components adding vectorially at the receiver aerial.

Possible aerial components for use in these aspects of the invention have already been disclosed in the UK Patent Specification No. 1475111 and accordingly the technical content of that specification is incorporated herein. That specification is a prior art form of microwave beam sensor in which the importance of reducing ground reflection is incorporated. The aerial arrangements were designed with the objective of reducing ground sensitivity, thus to reduce problems of false alarms created by moving and growing vegetation etc.

The prior art microwave transmitter and receiver are designed to be mounted vertically above the ground and have beam aerials of extended vertical aperture, of at least 0.75 meters (30 inches), to mitigate the effects of ground reflection. The preferred vertical aerials used were a slotted waveguide array with circular polarisation to minimise beam spreading.

Investigations revealed however that, whilst ground reflected components are less sensitive, the prior art sensor's capabilities are reduced. Whilst a walking, running or crawling intruder is detected, a rolling intruder, minimising his cross-sectional body area, will normally be undetected. Despite that problem, the system can be adapted for use in the present invention without the problem materialising Preferred embodiments of the above aspects of the invention can thus be derived as follows. Take this prior art intrusion sensor with reduced sensitivity to ground reflection and do not mount it vertically, as it is designed to be installed, but mount it in a horizontal plane, with both transmitter and receiver turned through 90° and elevated above the ground and sited to protect a vertical surface or face, e.g. of a scaffold. The reduced sensitivity at the surface edge of the field of detection is no longer a disadvantage as now the intruder is climbing and cannot make a vertical ascent without detection. It is not possible for the intruder to reduce his cross-sectional body area in a climbing mode as would be possible when rolling on the ground.

In real situations, microwave fences can be set up over irregular scaffold surfaces and/or scaffold surfaces which are in the open and may be covered by plastic sheeting or netting. At microwave frequencies scaffold netting and sheeting affects reflection, thus leading to variations in the effective surface level. Shorter term variations can arise out of plastic sheeting and netting moving in the wind. With the aerials now in the horizontal mode, the effects of surface reflection from the scaffold face, wooden boarding, plastic sheeting and netting are mitigated. Hence the problems of false alarms or failure to trigger an alarm condition are mitigated and a more predictable and reliable performance of the microwave sensor system is achieved.

In the horizontal mode the minimised beam spreading is a distinct advantage, allowing vehicles and pedestrians to pass below and beyond the controlled field of detection.

It has generally been assumed that the sensitivity setting of the aforementioned microwave system is such that birds and small animals penetrating the detection pattern will not create sufficient perturbation of the received signal for detection. Trials show that a bird or small animal within 0.5 to 1.0 m of the transmitter or receiver aerials can create an alarm condition. Similar conditions are created within 1.0 m of the transmitter or receiver aerial by melting ice, melting impacted snow and heavy (tropical) rain on the face of the radome.

A preferred embodiment of the invention overcomes all these aforementioned failings by extending part of the radome structure forward by a distance of say at least 0.5 m, e.g. 1.0 m, from the transmitter and receiver horizontal aerials.

The beam pattern or fence would be designed to have at least sufficient width horizontally so as not to be readily avoidable by an intruder. The minimum width of the fence is determined by the horizontal apertures of the aerials, taking into account that the fence spreads horizontally away from the aerials owing to beam divergence. For better security, it is preferred to use a horizontal aperture greater than that quoted, say 1.50 m, though the fence width would not normally be made so great that the movement of an intruder through the fence causes insufficient change in the received signal to provide reliable intruder detection.

As discussed in UK 1475111, a beam-forming aerial enables the effects of surface reflection to be at least substantially mitigated. To achieve best operation the striking angle a to the vertical surface of the reflected ray path between the transmitter and receiver aerials should not be less than half the half-power beam width ($\theta$) of each array, i.e. $\alpha \nless \theta/2$. This ensures that the reflected ray path lies outside the radiation patterns (−3 dB locus) of the aerials. $\alpha$ is a function of both the distance between the aerials and the aerial horizontal extent; $\alpha$ decreases with range and increases with horizontal extent. Thus at a great enough range $\alpha$ will eventually fall below $\theta/2$ but UK 1475111 shows how the above aspects of the present invention can be practised such that the range at which this happens is in excess of that likely to be required in practice. Increasing $\alpha$ by increasing aerial horizontal extent is not satisfactory since it is necessary in a practical fence for the fence to hug the vertical surface. UK 1475111 shows how aerials comprising a horizontal array of radiators can be used at or adjacent the vertical surface without difficulty from surface reflection. Such arrays should probably have a horizontal half-power beam-width of not more than 2°, as is preferred in the first aspect of the present invention.

The desired beam-widths can be conveniently realised with horizontal apertures of the size proposed at X- and K-band. For example, a horizontal aperture of 1.50 m at X-band will produce a half-power horizontal beam-width of less than 1°. The same aperture at K-band will produce half this beam-width or the same beam-width can be achieved by an array 0.75 m wide.

It will be appreciated that at X- or K-band ($\lambda$=0.03 and 0.015 m respectively), the aerial aperture is very large in terms of the number of wavelengths and in consequence very narrow beam-heights can be achieved with fence widths which are those desired in practice.

In discussing the beam-widths horizontally achievable at microwave frequencies, it is noted that aerial aperture in physical width is related to beam-width and that, regarding the surface reflection problem in terms of the horizontal beam pattern of the aerials, a beam width of not more than 2° is considered desirable.

It is preferred that the beam-forming aerials employed in a sensor according to the above aspects of the present invention provide circular polarization. Such aerials render the sensor less sensitive to the orientation of an intruder, e.g. a man climbing or crawling vertically, than tends to be the case with linearly polarized aerials and the use of circular polarization can also be of advantage in discriminating against reflections from vehicles, which is a factor that may arise in certain places where a fence is established. A slotted waveguide array is particularly suitable for this purpose.

In order to monitor the level of the received signal it is preferred to modulate the transmitter and to monitor the level of the detected modulation in the receiver. In addition it is desirable to make provision for compensating for long term variations in received signal level.

A complete intrusion detction system can be created from one or more such sensors. For example, where a complete building is swathed in scaffold, a combination of four or more sensors may suffice arranged to protect from frontal intrusion in an upwards direction. However, a single such sensor may suffice for detecting intruders climbing vertically downwards, i.e. from a roof onto scaffolding. Two such sensors side-by-side can adequately protect some scaffolding structures not only from access frontally but also laterally.

In many scaffolding schemes, the lateral distance to protect is less than 10 m, whereas the sensors described above are normally more effective over distances of 10 m to 150 m.

Thus, according to a third aspect of the invention there is provided an intruder detector comprising a first and a second passive infrared device each providing a set of detection pattern segments defining a first curtain and a second curtain respectively which extend along respective spaced-apart planes having a horizontal component. The intruder detector of the third aspect preferably further comprises a microwave transceiver secured to the, one of or both of the infrared devices and has a detection pattern overlapping or at least substantially coextensive with that of at least one of the infrared devices.

According to a fourth aspect of the invention there is provided an intruder detector comprising a passive infra-red device providing a set of detection pattern segments defining a curtain which extends along a plane extending with a horizontal component and, secured to the infra-red device, a microwave transceiver having a detection pattern overlapping or at least substantially co-extensive with that of the infra-red device.

The infra-red device or devices can be operated to provide a curtain of protection, e.g. by requiring interference on three successive patterns at a given rate. The microwave device, if present, can be arranged to create an alarm only when it and the infrared device indicate an intruder within a given time of each other, e.g. 15 seconds or less.

Preferably there is a third defence in the form of means physically attached to the devices to detect tampering, e.g. their removal or merely movement.

This aspect of the invention is based upon research to protect areas of scaffold of less than 10 m (33 ft). The operational range of the preferred embodiments is from 0.50 m (1.6 ft) to 15 m (50 ft). The detector can be designed to fulfil the need to protect scaffold 'end' faces, gantries, hoists, scaffold towers and other scaffold runs of less than about 10 m (33 ft).

The device can be installed independently or can augment the sensor of the previous aspects where required.

Utilising what are fundamentally two or three prior art technologies, the amalgam of these combined technologies into one device, providing at least one and preferably two horizontal infrared curtains, optionally in conjunction with a microwave transceiver having an at least partially coextensive detection pattern, satisfies stringent criteria for intruder detection systems to protect buildings in scaffold. A preferred system, especially for shorter scaffold, uses a curtain coverage, i.e. there can be provided an array of segments, e.g. providing two horizontal curtains of infrared (e.g. spaced apart in the vertical direction by 30 cm to 100 cm) or one such curtain in conjunction with a partially overlapping microwave field. Pairs of curtains can be conveniently arranged with one of them above scaffolding boards or the like and the other below. With this arrangement birds and other animals perched or walking on such boards do not interfere with the detector.

The preferred embodiment is a triple technology exterior detector which incorporates anti-mask microwave Doppler shift; two anti-mask passive infra-red detectors with stored timers and lens with curtain coverage pattern; and anti-sabotage reflected active infra-red. The technologies if used individually will not meet the criteria for reasons given later in this specification.

The preferred embodiment of the invention encompasses the above technologies into a new device and in this format, mounted on scaffold, overcomes the individual limitations of each of the prior art devices as follows.

The Doppler microwave detection pattern and a special passive infra-red curtain detection pattern comprising one or more curtains are preferably identical, up to a maximum range of, e.g., approx. 15 m (50 ft). To alter the pattern range to suit individual site requirements, the Doppler range control is infinitely adjustable to suit. The passive infra-red unit or units do not have an infinitely adjustable range control over their detection patterns. In this embodiment, the length can be changed only in fixed patterns by changing of lens or mirror segments. This is not considered to be a practically viable proposition for variable length scaffold. When both detection devices are deployed in unison, the passive infra-red pattern range beyond that of the microwave transceiver is nulled. To create an alarm condition both microwave and infrared devices are triggered within a given time, e.g. within 10 to 15 seconds of each other.

The intrinsic faults of an exterior infra-red detector, i.e. direct or reflected sunlight, wind chill factor, rapid temperature changes of nearby objects and variable detection pattern as exterior temperature changes, are overcome by the stability of the microwave detector which is unaffected by these failings.

Similarly the infra-red stabilises the intrinsic deficiencies of the exterior microwave transceiver, i.e. heavy rain, hail, snow, vibration, fluorescent lights, plastic water pipes, swinging ropes and the ability to penetrate glass and thin partitions.

The above shortcomings of both technologies are nullified with the exception of false alarms created by birds, cats and small animals in close proximity to the detectors. In addition the two technologies can both be misaligned when the system is disarmed without triggering an alert condition by rotating the scaffold pole to which the device is secured.

The preferred embodiment of this invention overcomes the aforementioned problems. The false alarm problem created by birds, cats, small animals etc. can be overcome by introducing two curtain lens from two anti-mask passive infra-red detectors in addition to stlred timers to the infra-red detectors. The two curtain infrared detectors are mounted horizontally, preferably 30 cm to 100 cm (12 to 39 inches) apart, and mounted raised up, preferably by at least 50 cm (20 inches), most preferably approximately at the level of the first boarded (or unboarded) lift, which is typically at around 2 meters (six feet six inches) above ground level, on the outer face of the scaffold. In this mode the twin curtain coverage pattern combined with a unique primer trigger operating in conjunction therewith via stored timers will only detect a climbing intruder and not generate false alarms due to spurious causes. An alarm condition occurs when the climbing intruder crosses both curtains of the detection pattern within a variable time limit. The two horizontal detection patterns and the positioning on the outer face of the scaffold alleviates false alarms created by birds landing or taking off or small animals jumping, as their path will be through the curtain detection pattern and will only trigger the primer trigger thus avoiding a false alarm owing to their speed.

The positioning of the two curtain lens on the outer face of the scaffold also allows birds and small animals onto the boards and horizontal poles of the scaffold to move freely without detection.

To avoid masking and deliberate misalignment of the detector when the system is disarmed, a reflected active infra-red beam transceiver is incorporated within the device. This transceiver, itself basically constructed according to prior art technology, transmits an active infra-red beam to a reflector and the reflector directs the signal back to the transceiver producing a continuous track. The transceiver and reflector are positioned to represent the approximate centre line and length of the detection field. Should the device be deliberately misaligned when disarmed, the active infra-red beam will cease to reflect and an alert signal will occur. Should deliberate sabotage, i.e. masking of the detector by placing objects in front of the detector occur, again the infra-red reflected path is interrupted and an alert condition will result.

The deficiencies of the active infra-red beam unit as described below are overcome by the device for the following reasons. The infra-red element is used or the purpose of checking the alignment only and not for detection of the intruder; hence the intrinsic shortcoming of the narrow beam is less relevant in this application. Optical alignment between conventional transmitter and receiver and the intrinsic problems are overcome by the reflector's single beam. The requirement to precisely align the single beam between transmitter and receiver is minimalised in the application of the reflected beam created by the transceiver; therefore the reflected path over the maximum 15 m (50 ft) provides a less precise but reliable signal pattern. Both the reflector and the transceiver can be protected by a prior art 24 hour anti-tamper circuit. The circuit can protect the mechanical fixings and prevent the re-siting of the devices or the purpose of perpetrating crime.

The active infra-red alignment circuit is intended to be disconnected when the 'control' equipment is disarmed to allow authorised personnel to access the scaffold. The alignment circuit is reconnected when a test circuit is initiated at the 'control' equipment. The test alignment circuit is automatically activated during the arming of the system. Provided no misalignment or masking of the active infra-red beam has occurred, the system will automatically set. In the event of misalignment or masking, the alignment circuit will remain open preventing the control equipment from setting, alerting the authorised personnel of the situation.

The test circuit can be activated whenever required when the system is disarmed, i.e. following reconfiguration of the scaffold etc. Where a communicator is installed, a 24 hour Central Monitoring Station can remotely activate the alignment test circuit if required.

When the system is armed the alignment circuit remains functional. An alarm condition will not be created however unless the circuit is activated for a minimum of 10–20 seconds indicating masking or misalignment. Blocking the active infra-red beam for more than 10–20 seconds continuously will create a full alarm condition. The variable time span allowed will be unaffected by birds or small animals flying or jumping through the infra-red beam pattern.

The three devices are to be mounted in a rugged plastic waterproof enclosure complete with their own cantilever poles and clips. Internal mechanical fixings are fully enclosed. The enclosure is protected by a 24 hour anti-tamper circuit.

BRIEF DESCRIPTION OF THE DRAWINGS

For a better understanding of the invention, and to show how the same may be carried into effect, reference will now be made, by way of example, to the accompanying drawings, in which.

DESCRIPTION OF THE PREFERRED

We shall initially refer to prior art systems when applied to external, scaffold, protection as shown in FIGS. 1 to 6.

Conventional Active Infra-Red Beam Units

Figure 1:
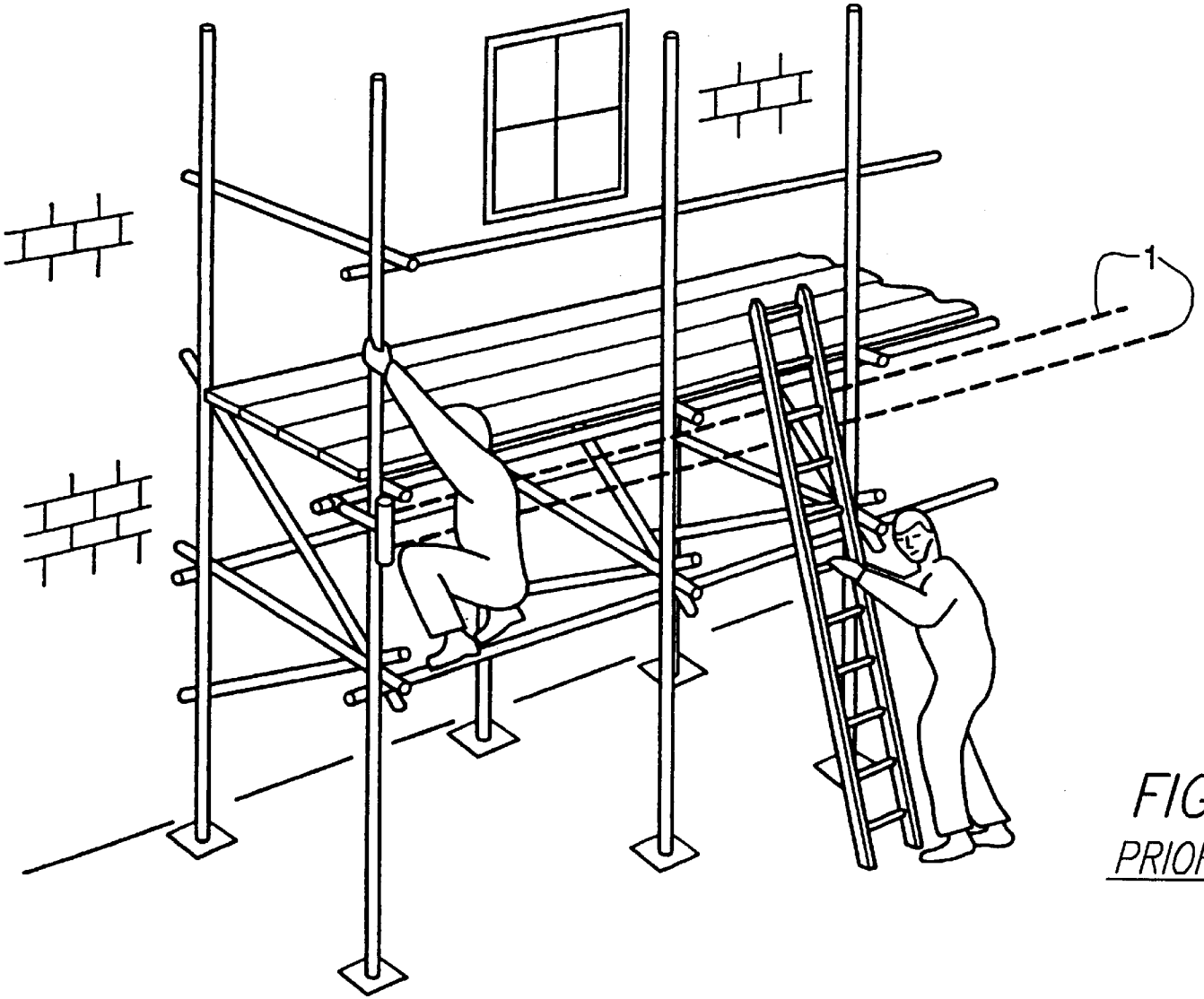
FIG. 1 PRIOR ART
FIG. 1 illustrates prior art conventional active infra-red beam units with narrow beam detection.

1. With reference to FIG. 1, standard single, dual or multi-beam units provide only a narrow beam line 1 of protection which can be easily overcome witch the aid of night vision facilities (the beam can be seen and avoided).

2. Such a device can also be easily overcome as the transmitters and receivers are visible, indicating the line of the protected area. The active infra-red beam 1 between transmitter and receiver housings is extremely narrow of non-volumetric character and can be easily avoided by a climbing intruder. Because the beam is narrow the device has to be positioned close to the face of the scaffold, affording the intruder the opportunity of climbing over the housing undetected.

3. Active infra-red beams will not operate satisfactorily a: less than 8 meters (26 feet), they therefore are unsuitable to protect ends of scaffold, towers, gantries, hoists etc.

4. Infra-red beams can also be adversely affected by heavy rain, fog, snow and vehicles' exhaust gases. The devices are not of suitable construction to withstand the rugged scaffold environment.

5. Active infra-red devices are optically aligned to function and the units are designed to be rigidly mounted to a solid structure. When installed to a temporary scaffold structure, the narrow active infra-red beam can drift out of optical alignment causing malfunction. Instability of alignment caused by traffic and working scaffold vibration is also a problem.

Conventional Exterior Passive Infra-Red P.I.R. Detector

Figure 2:
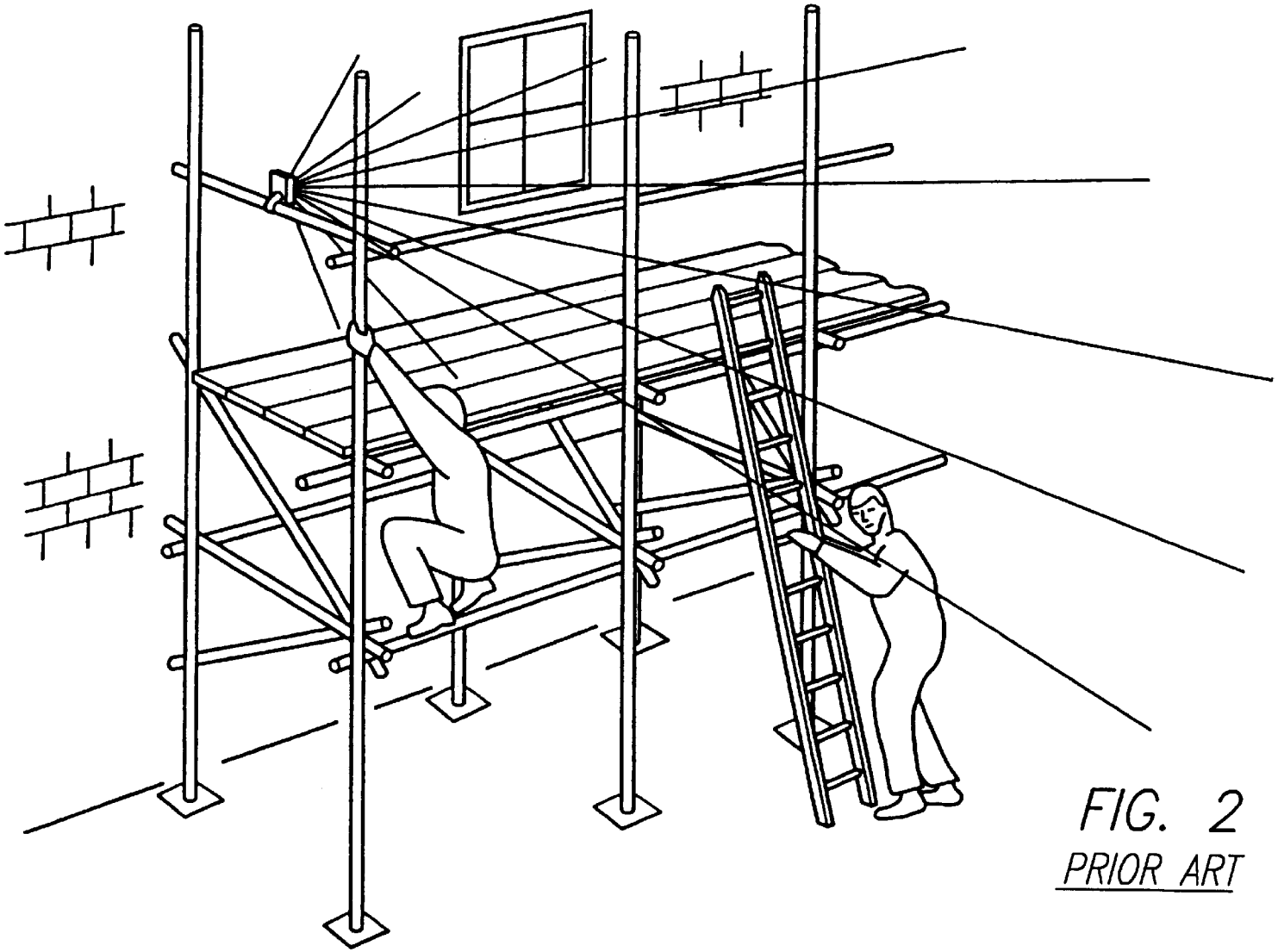
FIG. 2 PRIOR ART
FIG. 2 illustrates a prior art conventional passive infra-red detection system.
Figure 3:
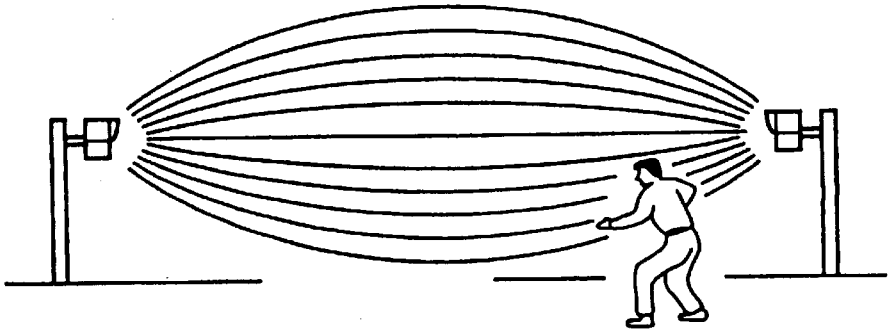
FIG. 3 PRIOR ART
FIG. 3 shows prior art conventional microwave detection patterns.
Figure 3:
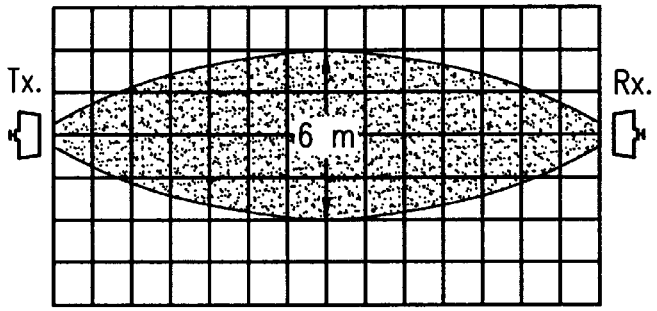
FIG. 3 PRIOR ART
Figure 3:
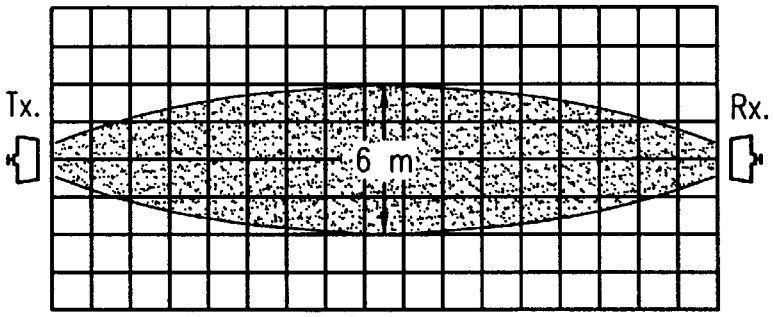
FIG. 3 PRIOR ART
Figure 3:
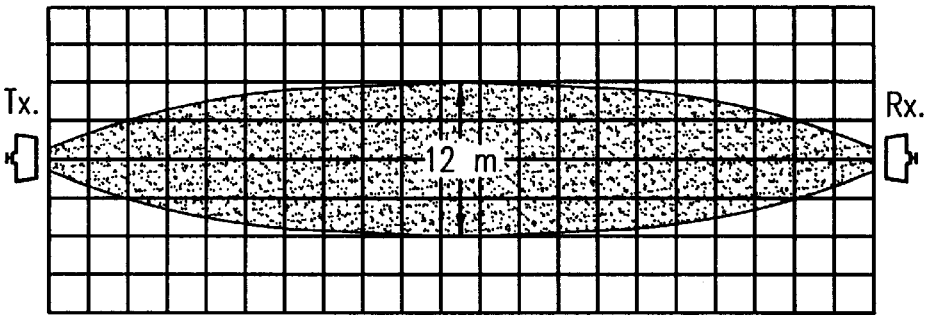
FIG. 3 PRIOR ART
Figure 4:
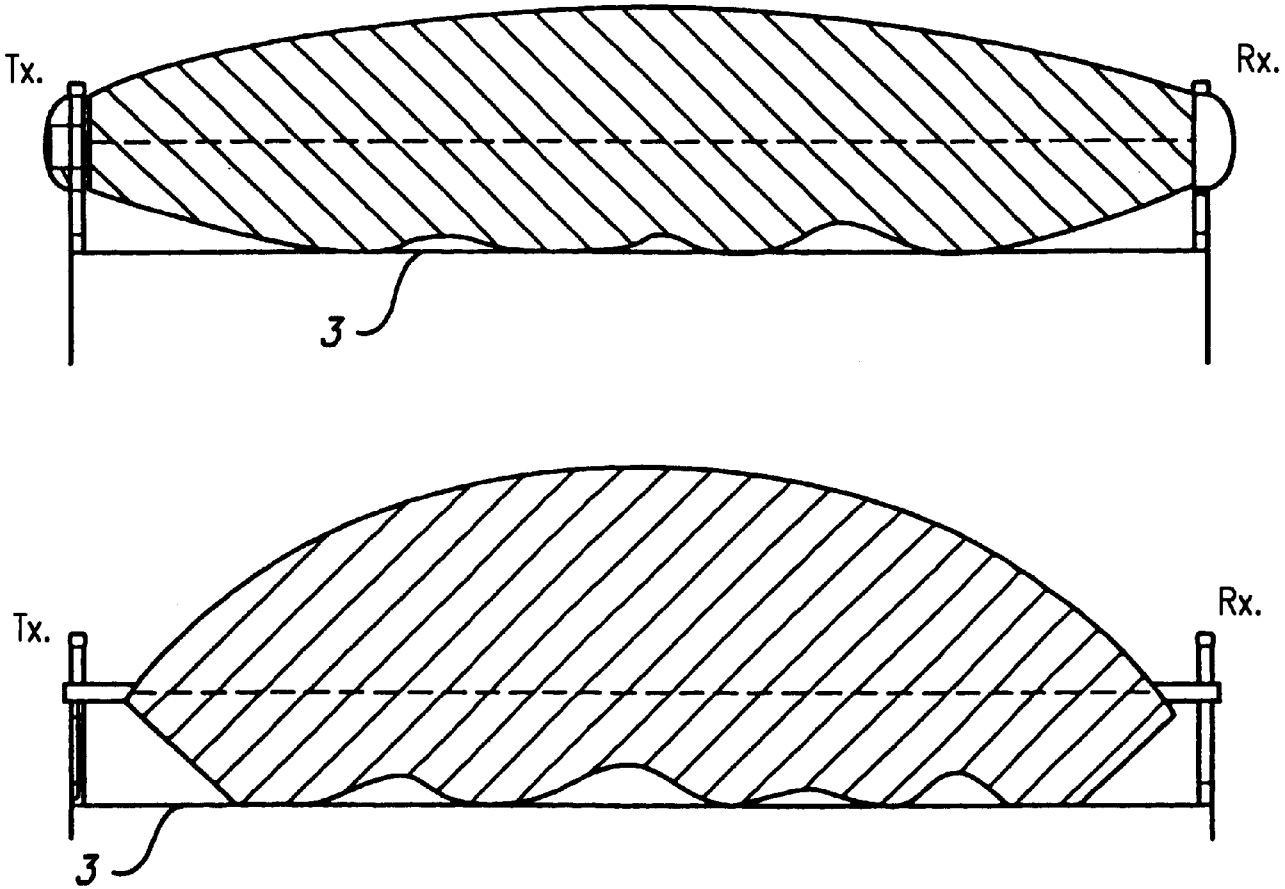
FIG. 4 PRIOR ART
FIG. 4 shows prior art conventional microwave detection patterns in contact with scaffold poles, boarding, sheeting, etc., being reflected, creating nulls and anti-phase signals leading to false alarms and unstable conditions.
Figure 5:
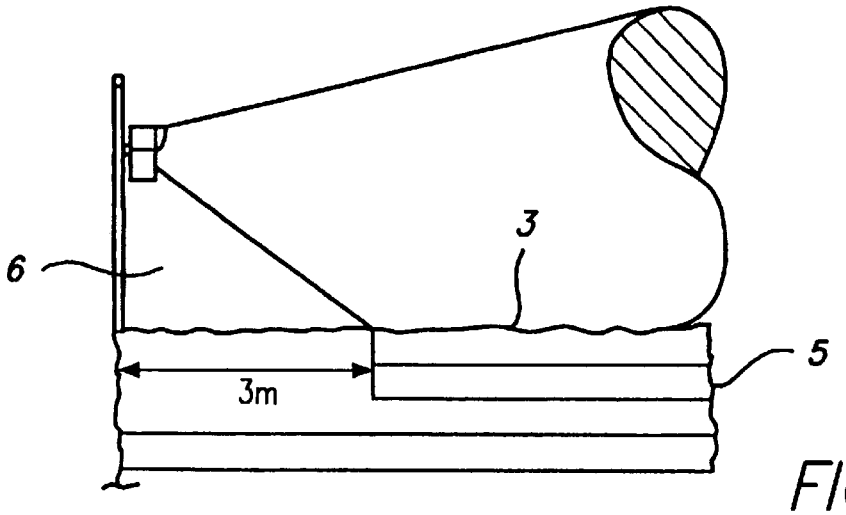
FIG. 5 PRIOR ART
FIGS. 5 and 6 show prior art conventional microwave detection patterns allowing an intruder 'clear space' in FIG. 5 or, in FIG. 6, with a minimum of 10 m right angle scaffold run available, a 3 m (10 ft) cantilever.
Figure 6:
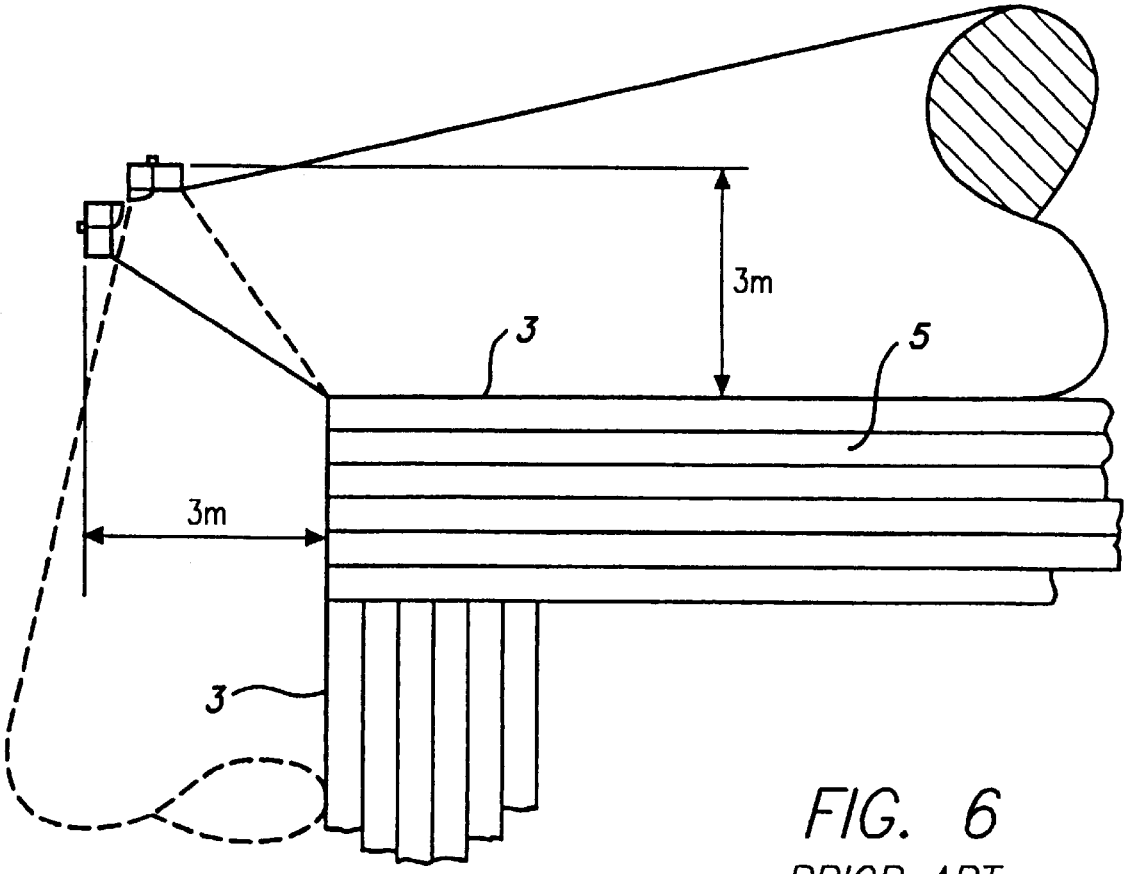
FIG. 6 PRIOR ART

1. With reference to FIG. 2, the standard lens detection field of a P.I.R., whether with a volumetric or long range pattern, operates up to a defined range. The devices do not have an infinitely adjustable limitation on the range to suit individual lengths of scaffold and the pattern of coverage is often either too great or insufficient for requirements.

2. Passive infra-red detectors are adversely affected and false alarms are created by direct or reflected sunlight, wind chill factors, rapid temperature changes of nearby objects. The detection field also varies as the external temperature changes, hence false alarm situations can be created from pedestrians and traffic below.

3. Passive infra-red detectors are also subject to false alarms created by birds and small animals, especially in close proximity to the device. This often occurs where the detection pattern is covering the boards and poles of the scaffold.

4. An exterior detector would be easily sabotaged by masking or misalignment without creating an alarm condition whether armed or disarmed.

Conventional Microwave Doooler Shift Transceiver

1. Standard microwave (radar) transmissions and receptions are employed to provide a variable volumetric detection pattern. The detector operates on the principle of a Doppler shifted (reflected) signal from the moving intruder; this principle is satisfactory in an interior situation but is unreliable in an exterior environment. The reflected signal can be confused and create false alarms by: heavy rain, hail, snow, vibration, fluorescent lights, plastic water pipes, swinging ropes, birds and small animals in close proximity to the detector, and the ability to penetrate glass and thin partitions.

2. An exterior detector can be easily sabotaged by masking or misalignment without creating an alarm condition in the disarmed mode.

Conventional Intruder Electronic Vibration Sensors, Microphonic Wire and Geoohonic Sensors 1. The standard sensor systems are unreliable when deployed on exterior scaffold. In order to detect an intruder climbing scaffold or walking on scaffold boards, a standard vibration detector's sensitivity needs to be set at near maximum level. This results in false alarms created by resonance and vibration from passing traffic, whaling sirens (emergency vehicles), nearby plant and machinery, and pedestrians knocking the scaffold below.

2. Similar unsatisfactory results are experienced with microphonic wire, geo-phonic sensors.

Acoustic Detection Devices

1. The standard acoustic (audio) detector is unsuitable for use in a scaffold environment because it cannot discriminate between the noises created by intruders or the hubbub of confusing ambient noise from trains, road traffic, nearby plant and machinery, passing pedestrians, etc.

Electro-Static Field Wire System

1. The standard system is triggered when a human being is in close proximity to the wire array containing the field of detection. The device is adversely affected by the close proximity of metal scaffold. If distanced from the face of the scaffold the parallel wires are subjected to entanglement and breakage from ladders, hoists and ropes. A high false alarm rate is experienced.

Conventional Microwave seam Detectors

1. With reference to FIGS. 3 to 6, standard external microwave beam detectors would not be satisfactory as applied to scaffolding because the beam width cannot be controlled, giving rise to false alarm situations created by passing traffic to the side extremities of the beam and from pedestrians and traffic below. For example, on a scaffold run of between 30 m (90 ft) and 100 m (330 ft) the average microwave detection beam diameter is 6 m (20 ft). This is unacceptable on the outer faces of boarded scaffold (see FIG. 3).

2. The sensitivity of the detection beam is consistent throughout its circumference and length. When the signal is in contact with the scaffold poles 4, boarding 5, sheeting 3, etc. the signal is reflected creating nulls and an anti-phase signal. Unprotected areas and false alarms are likely to result from these unstable conditions (see FIG. 4).

3. Owing to the signal pattern close to the transmitter and receiver, a void area exists allowing an intruder 'clear space' 6 (FIG. 5) to climb the scaffold undetected. This feature is a drawback common to all standard microwave detectors and can only be minimised when a 10 meter (33 feet) or more scaffold run at right angles is available to install a secondary transmitter and receiver in a crossed signal pattern format to provide cover to the void area (see FIG. 6).

4. The majority of scaffold end faces are approximately 2 m wide only; therefore a secondary set of detectors cannot be used thus leaving an unprotected area of scaffold for the intruder to enter.

5. Should additional security in the form of a secondary transmitter and receiver be installed in parallel to the outer microwave detectors in an attempt to protect the vulnerable windows and boarded area of scaffold, this does not eradicate the problem. The detection signal pattern is adversely affected, reduced and 'tunnelised' by the framework of scaffold poles 4. The sensitivity of the detection signal being consistent over the circumference and length of the signal pattern causes nulls and anti-phasing on at least two faces of the signal pattern. This mode will cause false alarms and instability in changing environmental conditions.

6. A further drawback to the use of a standard microwave detector, particularly if deployed on scaffold on a glass fronted or large windowed building, is the inability to control the width of the signal array to prevent the signal from penetrating into the building via the glass and interfering with electronic business machines, radio equipment, etc.

7. All standard microwave detectors will ignore birds and small animals within the majority of the signal pattern when the level of sensitivity is correctly set. The standard detectors will alarm when a bird preparing to land in a slow flying format enters the detection signal pattern within 1.0 m from either the transmitter or the receiver. When a standard microwave is installed on a scaffold, the number of birds landing and taking off from the scaffold close to the detectors is greatly increased. Hence there is a high false alarm probability.

8. Standard microwave detectors can generally only be deployed on scaffolds in excess of 10 m–200 m. If deployed on scaffold runs of less than 10 m the signal is unstable and cannot be satisfactorily reduced to reliably operate. This would exclude the majority of scaffold towers, hoists, gantries, individual urban residences and shop fronts which tend to be less than 10 m wide.

With reference to FIGS. 7 to 14, various systems are now proposed using one or other or both of what we refer to herein as an intrusion sensor and an intruder detector. In the systems shown in FIGS. 7 to 12, both are employed whereas only one is employed in FIGS. 13 and 14.

Figure 7:
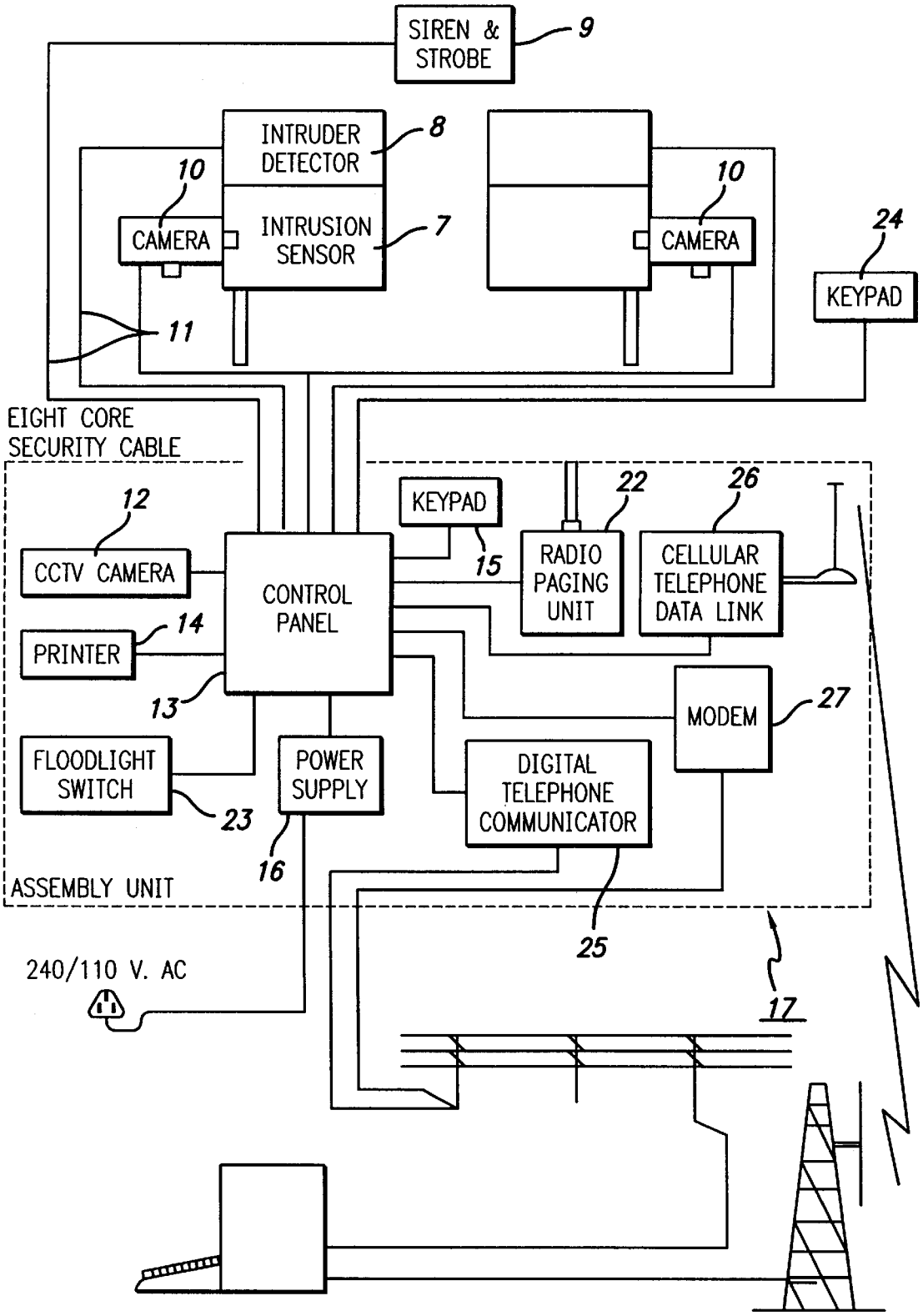
FIG. 7 shows a block schematic diagram of installation and components to meet the specification described herein for a wired system.
Figure 8:
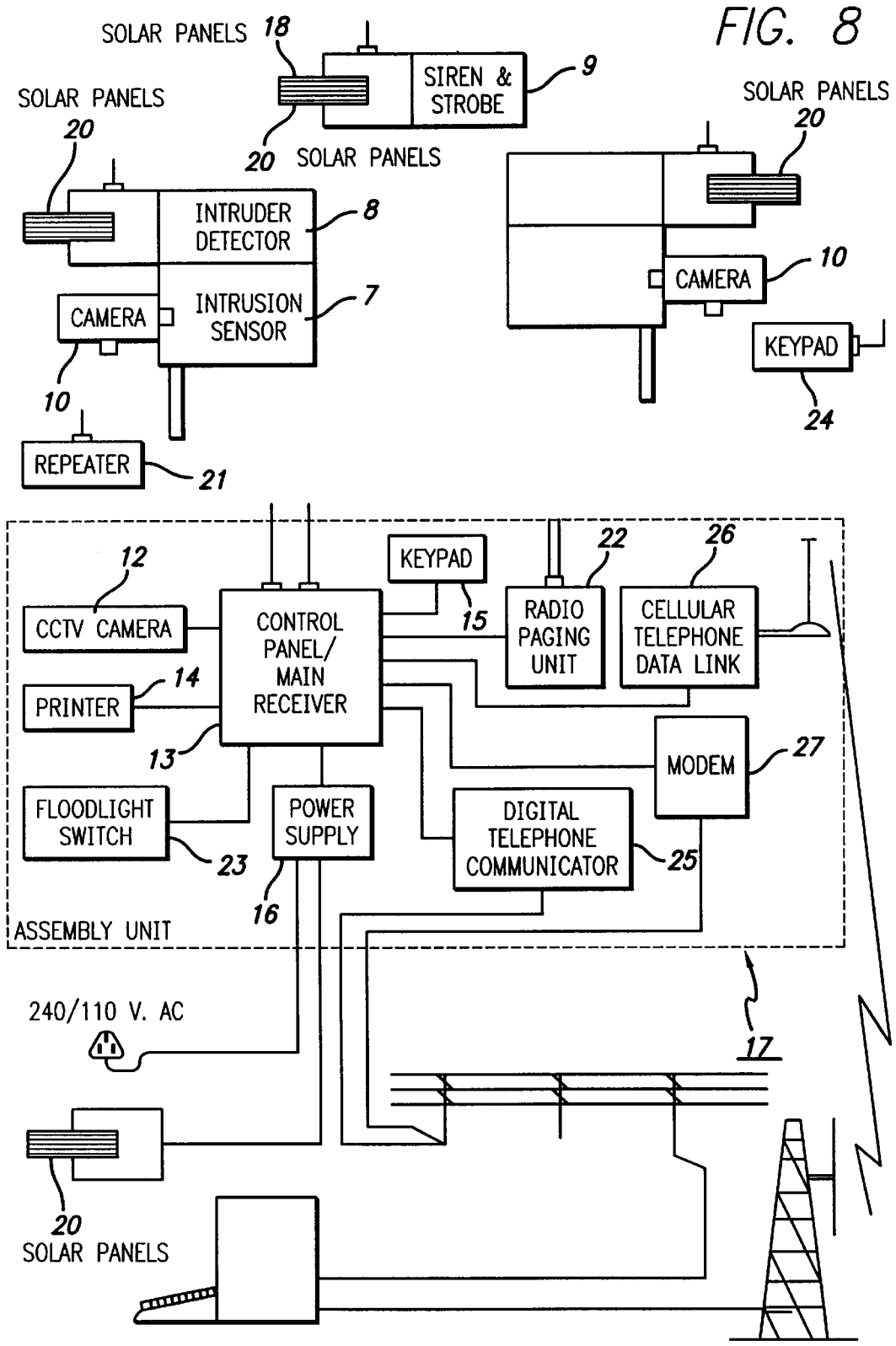
FIG. 8 shows a block schematic diagram of installation and components to meet the specification described herein for a radio signalling wire-free system.

The overall systems shown in FIGS. 7 and 8 are designed according to the following specification:

System Installation Specification

1. To flood the scaffold with a controlled energy field, to detect only an intruder of mass greater than 4 stone (25 kg) and/or an intruder climbing vertically.

2. To detect an intruder attempting to climb the outer face, corners or the side faces of a boarded scaffold as erected (see FIG. 12) to detect an intruder climbing the face of scaffold abutting a building, where access is available.

3. To detect an intruder climbing any of the sides, faces, corners or up through unboarded scaffold (see FIG. 13).

4. To detect a human intruder before reaching the first lift of scaffold or the first level of windows above the ground breached by the scaffold (other levels adjoining roofs etc. to be protected if required—see FIG. 11).

5. The detection system is not be activated by pedestrians or vehicles below or beyond the sides of the protected scaffold. The detection field must not penetrate windows or interfere with business machines within the building.

6. The principle cover of the detection system is to provide an invisible wall of energy from 0.5 m (1.6 ft) to 150 m (500 ft) long.

7. The width and height of the protective energy field must not be defined or overcome by an intruder.

8. As an intruder attempts to enter the protected area a siren and pulsating strobe light is immediately activated for a pre-determined time usually 1 to 3 minutes, the siren to then shut down and the entire system to automatically re-arm.

9. Option Where required, the system will also activate floodlights or, if floodlights are switched on constantly during darkness, the system pulsates the floodlights during an alarm activation.

10. Option Where required all system events are to be transmitted via a communicator to a 24 hour Central Monitoring Station.

11. Option Where required the system will be augmented by the alarm photo verification cameras to view the field of detection. As an intruder enters the protected area the detectors will activate the photo verification cameras infrared flash units to record a number of still photographs. The images are transmitted within 15 seconds to the 24 hour Central Monitoring Station with the standard intruder event signal. Where required, detectors interfaced with full CCTV system for monitoring, recording or transmission.

1. Exterior System Specification

1. The detection devices are mounted in rugged elastic weatherproof cases complete with their own cantilever scaffold poles and clips positioned at each end outside the main framework of the scaffold. This provides the maximum detection area for the energy field along and through the scaffold with the minimum risk of accidental damage from the working environment. The plastic cases are sealed to prevent water, dust, insects etc. from entering the unit.

2. The energy detection field is unaffected by vibration, wind, falling leaves, flying debris, dust, rain, hail, fog, frost, ice, snow, sunlight or temperature extremes.

3. The energy detection field ignores birds and small animals.

4. The energy detection field is stable and unaffected by the scaffold metal structure, scaffold debris netting, tarpaulin sheeting, polythene cladding or scaffold wood boarding.

5. The electromagnetic radiation and frequency meet the requirements of the D.T.I. (UK), F.C.C. (USA), plus other countries where required.

6. The detection and allied electronic equipment is unaffected by any high pitched sirens and mobile radio transmitters, i.e. fire brigade, police, ambulance, cellular telephones, etc.

7. Detectors and equipment are shielded to reject R.F.I. (Radio Frequency Interference). Cabling is fully shielded where required.

8. All electrical current from internal control equipment to detectors and siren is reduced to 24V DC max. to comply with Health & Safety at Work Acts and Codes of Practice appertaining to scaffold. Detectors are earthed to scaffold pole, which in turn is earthed to the main scaffold structure.

9. To avoid deliberate sabotage the detectors are anti-masking to maintain the consistent detection pattern at all times as installed. During the working day when the system is disarmed, any deliberate sabotage by mechanical misalignment of the detectors or the placing of large objects in front of the detectors will be indicated at the control panel. The area of sabotage to be indicated and the system will not arm until a 24 hour call-out engineer realigns to cover precisely the protected area. If mechanical misalignment occurs whilst the system is armed an instant full alarm condition is created.

10. Tampering of cables, enclosures, control equipment, etc., is protected by a separate 24 hour anti-tamper circuit. Should any of the above anti-tamper circuits be activated an audio visual tamper alert (stating location) to appear at the internal control panel and where an optional communicator is fitted, a tamper (sabotage) signal is sent to the Central Monitoring Station to inform the 24 hour engineering call-out service and sanctioned authorities.

11. External siren and strobe light are housed in a tough polycarbonate enclosure and fastened to scaffold. When the system is disarmed during daytime works, should the siren cable be cut or the enclosure tampered with, the siren to activate, driven by its individual rechargeable internal battery. The siren and strobe unit to be clearly labelled 'scaffold electronic protection' to avoid any confusion with any other alarm siren which may sound in the nearby location.

12. Option Where access is not available to the interior control equipment, an external digital keypad in a vandal proof, weatherproof, lockable enclosure is provided to allow arming and disarming of the system without the need to enter the building. The external digital keypad to have a back lit display for night use, to be capable of interrogating the event memory and be protected by the 24 hour anti-tamper circuit.

13. Option Where required the detectors will be interfaced with the intruder photo verification cameras to view the field of detection. As an intruder enters the protected area the detectors will activate the infra-red flash units to record a number of still photographs. Interface to detectors also for full CCTV camera system.

2. Interior System Specification

1. All control and communication equipment is assembled and mounted to form free standing portable appliance and a Certificate of Inspection is to be issued to comply with the Electricity at Work Act. The control equipment is sited within a secure area of the building, site office or security lodge.

2. The system is armed and disarmed from a digital keypad situated with the main control equipment. The control equipment indicates the area of scaffold being violated by an intruder and activate an internal sounder (volume level adjustable). The audible internal sounder activates if a tamper (sabotage) occurs to any of the detectors, cable, siren or control equipment whether the system is armed or disarmed (24 hours a day). The precise location of the tamper is indicated.

3. Upon an alarm activation the internal control equipment instantly alerts a 24 hour porter, security staff, keyholders, police authorities, etc. If required, the intruder violation message is transmitted instantly electronically via a radio paging system, a telephone digital communicator or a cellular phone Data Link.

4. All events to the system are also recorded at the control equipment situated within the building or site office and displayed on a liquid crystal display or a real time printer. The events to be displayed:

Time, date and location on scaffold of an intruder violation

Time, date and name of the person who armed or disarmed the system

The digital keypad the person used (internal or external)

If the authorised person arming the system deliberately omits (bypasses) any part of the system, and which area(s) omitted.

Time, date and location of a tamper (sabotage) of detectors, cable control equipment, etc. whether the system is armed or disarmed (24 hours)

Power supply failure time and date

Telephone line failure.

5. The system is supplied with rechargeable back-up batteries for use in the event of a mains failure. The system to maintain normal operations for 24 hours. During a prolonged power failure, an audible and visual warning to occur and where communicator is fitted a signal to be sent to the Central Monitoring Station to alert the 24 hour engineering call-out service and the sanctioned authorities.

6. Option The remote signalling From the intruder violation is received within 10 to 15 seconds by a British Standard Central Monitoring Station. The 24 hour a day staff to immediately alert private security, porters, authorised residents, keyholders, neighbourhood watch, police authorities etc. If the building is secured with an internal alarm system the staff to also alert the internal alarm monitoring station to be on standby. If the internal alarm is then activated the police can be informed both external scaffold alarm followed by the internal building alarm have been activated (positive verification). The 24 hour keyholding/alarm reset service to be contacted where required. All event signals and action taken are recorded by the Central Monitoring Station including 'site open', 'site closed', 'intruder', daytime 'tamper/sabotage', and in the event of a prolonged mains failure 'low standby battery'. An event signal is also recorded if the authorised person arming the system deliberately omits (bypasses) any part of the system. The cellular phone Data Link is also monitored to check site equipment, cell transmission and reception.

7. Option Where exterior detectors are installed with the intruder photo verification system, a number of still photographs will be received via the communicator on the computer screen at Central Monitoring Station. This will happen simultaneously with the normal intruder event signal. All events/photos received and action taken are recorded and can be despatched in hard copy or electronic formats. System interface also for full CCTV system monitoring, recording or transmission.

8. Option The control equipment on site will facilitate the computer access of the memory unit (down loading) by the Central Monitoring Station via the communication. The functions may be remotely analysed, checked and reprogrammed by authorised personnel if required.

In order to overcome all the operational limitations of conventional external intruder detection equipment when deployed on scaffold as previously described, two new detectors have been invented. These detectors can be so designed as to meet the criteria required and overcome all the limitations of conventional equipment. The following gives a list of components for installation to meet the specification with reference to FIGS. 7 and 8.

WIRED SYSTEM

Exterior Equipment (Wired) (See FIG. 7)

1. The intrusion sensor 7 with a detection range of 10 m (33 ft) to 150 m (50 ft).

2. The intruder detector 8 with a detection range of 0.5 m (1.6 ft) to 15 m (50 ft)

3. Siren and strobe unit 9.

4. Warning signs (standard equipment).

5. Eight core security cable 11 (standard equipment).

6. Option Intruder Photo Verification Cameras 10 complete with infra-red flash unit interfaced with the detectors and sensors.

7. Option Full CCTV camera 12 interfaced with detectors (standard equipment).

Interior Control Equipment (Wired) (See FIG. 7)

1. A Control Panel 13 is fifteen zone expandable with a 1000 event memory computer down loading capability, output for real time printing and alpha numeric paging.

2. Digital LCD keypad 15 which is back lit.

3. Power supply unit 16, 12V and 24V DC, including standby rechargeable batteries.

4. Assembly unit for control equipment to form a free-standing portable appliance 17 (a new invention in itself)

5. Option Real time printer 14.

RADIO SIGNALLING (WIRE FREE SYSTEM)

Exterior Equipment (Wire Free) (See FIG. 8)

1. Intrusion sensor 7 with a detection range of 10 m (33 ft) to 150 m (50 ft).

2. Intruder detector 8 with a detection range of 0.5 m (1.6 ft) to 15 m (50 ft).

3. To interface with items 1 & 2 solar panels 20 for UK climate use, including rechargeable battery pack and a polling (supervised) radio transmitter.

4. Siren and strobe unit 9 also with solar panels 18 for UK climate use, inluding rechargeable battery pack (modified technology) and a polling supervised radio receiver.

5. Warning signs (standard equipment).

6. Option Intruder photo verification cameras 10 complete with infra-red flash unit interfaced with detectors and sensors.

7. Option Full CCTV camera 12 interfaced with detectors.

Interior Control Equipment (Wire Free) (See FIG. 8)

1. Control panel 13 fifteen zone expandable and with 1000 event memory computer down loading capability, output for real time printing and alpha numeric paging. 50 signal expandable polling (supervised) radio received with siren radio transmitter.

2. Digital LCD keypad 15 back lit.

3. Standby rechargeable batteries 16.

4. Assembly unit 17 for control equipment to form a free standing portable appliance 17.

5. Optional Real time printer 14.

6. Optional Solar panels for UK climate use (if mains power is not available) plus rechargeable battery pack.

7. Optional Radio signal repeater unit 21 to receive all transmissions from detectors etc. and retransmit to main receiver 13 (for large sites). WIRED AND WIRE FREE SYSTEMS Interior Communication Equipment (See FIGS. 7 and 8) Options 1. Radio paging unit 22 (½ mile transmission), signal tone, 4 tone or alpha-numeric all event display (standard equipment).

2. Floodlight switching unit 23 to switch floodlights or pulsate floodlights during an alarm activation (standard equipment).

3. External remote digital keypad 24 in vandal proof, weatherproof, lockable enclosure (standard equipment).

4. Digital telephone communicator 25, all system events to 24 hour Central Monitoring Station (standard equipment).

5. Cellular telephone data link 26—all system events to 24 hour Central Monitoring Station, including standby rechargeable batteries (standard equipment).

6. Intruder photo verification modem 27 to transmit several still pictures of intruder to 24 hour Central Monitoring Station with the event signal (standard equipment).

7. Full CCTV monitoring, recording and transmission system interfaced and activated by the detectors (standard equipment).

As previously described, two new devices have been invented. The intrusion sensor and intruder detector are the subject of discussion below and will preferably be designed to meet the aforementioned specification when deployed either individually or together in unison depending on the configural demands of the scaffold or building (see FIGS. 9 and 10). The preferred forms of these detectors are free from all those inherent operational deficiencies which are characteristic of conventional prior art detectors. The two new detectors plus design additions and modifications to established control, communication and audible warning equipment make this a unique total system concept. Before detailing these devices it should also be mentioned that there are additional uses in complete intruder detection systems as follows:

1. The entire system can be used to protect the external faces of buildings, walls, hoardings, enclosures in fact any perimeter above ground where a climbing intruder is to be detected.

2. The entire system can be deployed to protect exterior perimeters at ground or flat roof level, particularly adjacent to buildings, walls, hoardings, fences etc., or between security fences at a minimum of 3.0 m apart. The ground or surface would be expected to be quite flat and free from growing vegetation, rivers or ponds (grass to be maintained at 25 mm or less) unless mounted sufficiently above the ground.

3. The entire system can be used in a rapid deployment mode, i.e. mounted on tripods (or free standing scaffold poles in concrete bases). The control equipment would then be encased within rugged weatherproof enclosures.

Figure 15:
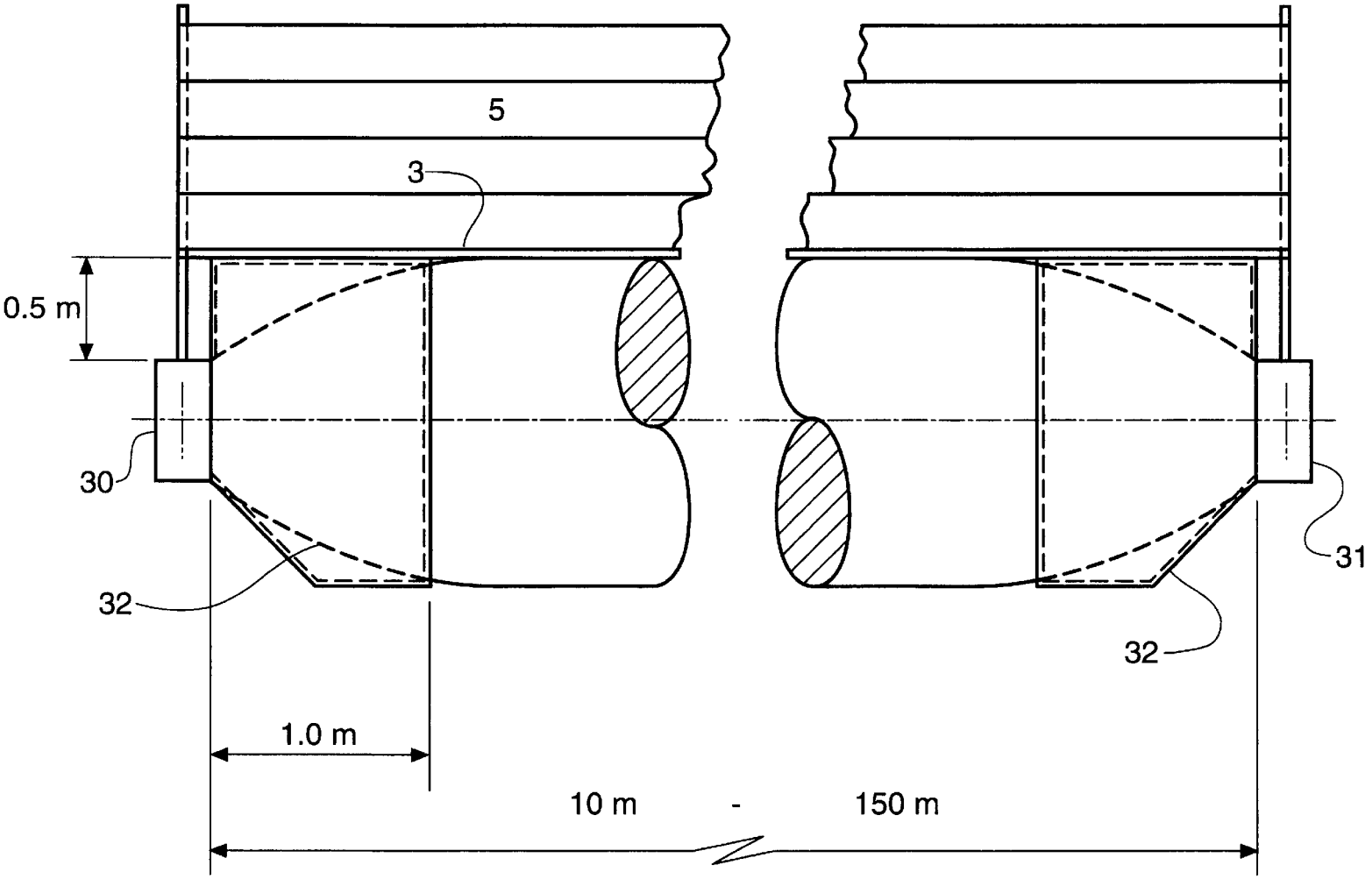
FIG. 15 is a plan view of an intrusion sensor.

Referring to FIG. 15, there is shown a plan view of an intrusion sensor attached in front of a scaffold face 3. A transmitter 30 with its associated aerial of large horizontal aperture and a receiver 31 with its associated aerial which is assumed to be identical to the transmitter aerial. The aerials are designed according to the principles of UK 1475111 to substantially reduce the surface reflected component. Such a reduction can be achieved at practically required ranges by reducing the half-power beam-width of the aerials so that $\theta/2$ is less than the striking angle $\alpha$, though this is not to be taken as a definitive statement for all situations. In order to achieve this the aerials have large horizontal apertures thereby reducing the beam-width $\theta$ and the apertures are made not less than 0.50 m long in order to provide a reasonable minimum fence width.

Each aerial is an array of horizontally stacked elements such as may be realised at X-band frequencies by an array of slot radiators which will be assumed to be vertically polarised. The structures of the aerials may be as for any embodiment in UK 147511.

The use of multi-element array is helpful in providing gain for the system and more particularly for reducing the horizontal beam-width. With an array of the kind contemplated the half-power beam-width may be readily brought down to 1° or less which would be much less than the striking angle a of any reflected component over practical ranges, i.e. $\theta/2 \ll \alpha$.

Radomes 32 of the aerials are extended by about 1 m towards one another and their facing sides are physically closed by a microwave transmissive barrier, this structure preventing small animals entering the area close to the aerials in which the microwave system would otherwise be vulnerable. They are also extended to the scaffold face at their inner sides to block off an area close to the aerials where there would be no response.

By employing large horizontal apertures, the performance of the system at different locations is far more predictable and far less liable to variations once installed due to plastic sheeting and netting altering the effective value of aerial length 1 or to movement of such sheeting and netting affecting 1. Thus the false alarm probability is greatly reduced and there are no null ranges at which the system will tend to operate unreliably.

Figure 16:
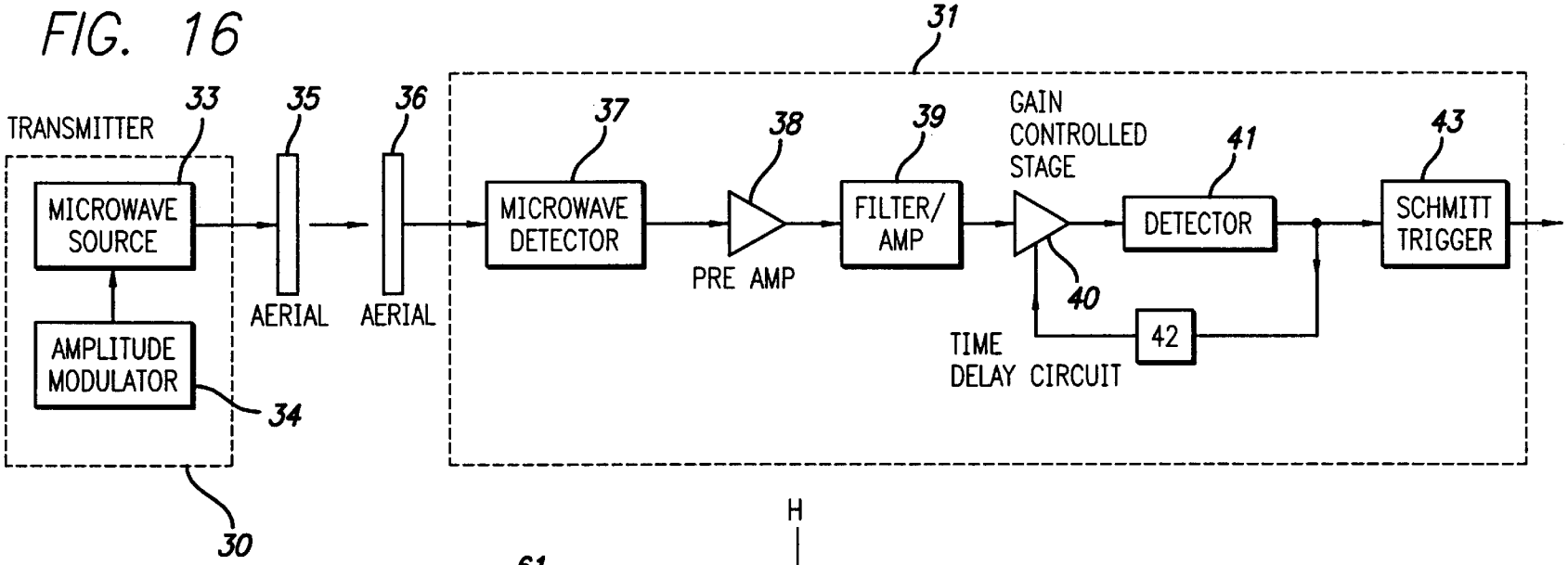
FIG. 16 is a block diagram of the circuit of the intrusion sensor system.

To take advantage of the large horizontal aperture arrays, there will now be described with reference to FIG. 16 a block diagram of an intrusion sensor circuit. In FIG. 16 the transmitter 30 comprises a microwave source 33 such as a Gunn diode or Ga As PET and an amplitude modulator 34 which may be provided by a multivibrator giving square wave modulation at a selected frequency in the audio range. The modulated Gunn diode output or Ga As FET, in X-band say, is applied to the aerial 35 which may be an extended array of slot radiators giving the kind of response already discussed and which for weather protection is entirely enclosed by the low-loss radome 32 through which the X-band radiation is emitted. The transmitter 30 can also be enclosed within the same housing.

The receiver 31 has a similar aerial 36 feeding a microwave detector 37 to recover the audio modulation with a following preamplifier 38 which itself is followed by a filter/amplifier 39 having a pass-band at the modulation frequency. The filtered signal passes to a gain controlled stage 40 which is in an automatic gain control (a.g.c.) loop acting to establish a substantially long term constant modulation signal output for further processing. The filtered modulation signal is rectified by a detector 41 to provide a d.c. signal the level of which follows the modulation signal level. Dart of the d.c. signal is Led back as an a.g.c. signal to stage 40 via a time delay circuit 42, e.g. an R.C. delay circuit. The delay circuit has a delay greater than 1 minute. The a.g.c. loop maintains the d.c. output of detector 34 substantially constant for long term variations. Relatively rapid input signal variations as caused by the movement of an intruder through the microwave fence between aerials 35 and 36 will not be compensated by the slow acting a.g.c. loop and will appear as corresponding changes in the d.c. signal from detector 34. The d.c. signal is applied to a Schmitt trigger 43 so that a sufficient change of the d.c. level will activate the Schmitt trigger to produce an alarm signal.

Figure 17:
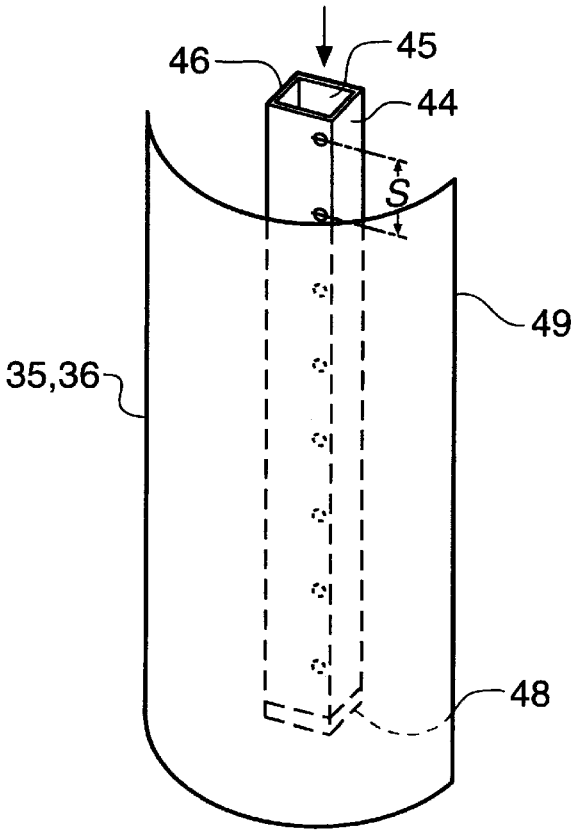
FIG. 17 is a simplified perspective view of an aerial array usable in the system of FIGS. 15 and 16 and providing circular polarization.

A preferred embodiment uses an intrusion sensor of the kind discussed with a large aperture linear array having circular polarisation. One such microwave array is illustrated in FIG. 17.

Array 35 or 36 is a slotted waveguide array, comprising a solid dielectric waveguide 44 having a dielectric core 45 plated with metal 46 the thickness of which is exaggerated in the figure. At uniform intervals s along one broad wall off-set radiating apertures 47 are provided. These apertures can be circular holes or X-shaped (the term slotted-waveguide is used broadly to encompass any shape of apertures) and may be as described in UK 147511, except the total horizontal aperture may be a low as 0.5 m.

The radiating apertures 47 are off-set from the longitudinal axis of the broadwall toward one side in order to obtain circularly polarized radiation as is explained in the report above mentioned, the degree of offset being chosen to give the best circularity. A better understanding of the mechanism by which circular polarization is obtained will result from the description later of a slotted waveguide of FIG. 19. If the waveguide is fed from one end as indicated by the arrow in FIG. 17 the other end will be terminated in a matched load 48 in order to prevent reflections. The sense of the radiated circular polarisation depends on the direction of wave propagation in the guide 44 and a reflected wave from the other end of the waveguide would tend to make the induced circular polarization revert to linear polarization.

As well as terminating the guide in a matched load it is desirable to gradate the coupling of the apertures 47 to the waveguide 44 in order to obtain the required power distribution for achieving the desired narrow beamwidth of the array.

Thus the array 35 or 36 can be designed to meet the requirements of:

1) an array not less than 0.50 m long;

2) a narrow beamwidth in the horizontal plane without excessive side-lobes; and 3) circular polarization.

Finally to narrow the horizontal beamwidth, and thereby aid in reducing reflections from passing traffic, the slotted-waveguide 44 radiates into a semi-parabolic reflector 49.

Figure 18:
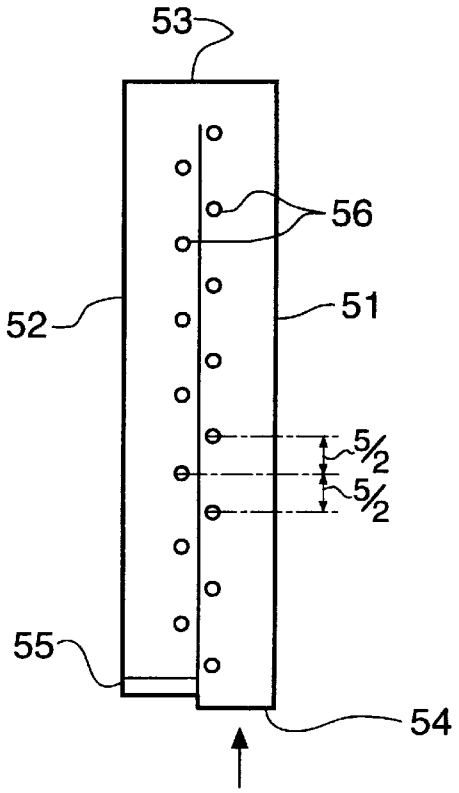
FIG. 18 is a simplified front view of another aerial array providing circular polarization and usable in the system of FIGS. 15 and 16.

FIG. 18 illustrates an alternative array 50 which is again based on the principles given in UK 1475111. The array 50 has two parallel waveguide sections 51 and 52 which are coupled in series via a u-section 53. One of the two sections 51 and 52 is fed at the inner end 54 while the inner end of the other is terminated in a matched load 55 for the reasons given above. The waveguide sections may be loaded or unloaded and have apertures 56 spaced there along at a distance s between adjacent apertures in one waveguide, the apertures being formed to produce circular polarization as previously discussed. The radiating aperture 56 in the two parallel sections are staggered horizontally so that an aperture in one waveguide section lies midway in the horizontal direction between two apertures in the other and produces circular polarization of the same sense. Again UK 1475111 may be referred to for detailed information.

Figure 19:
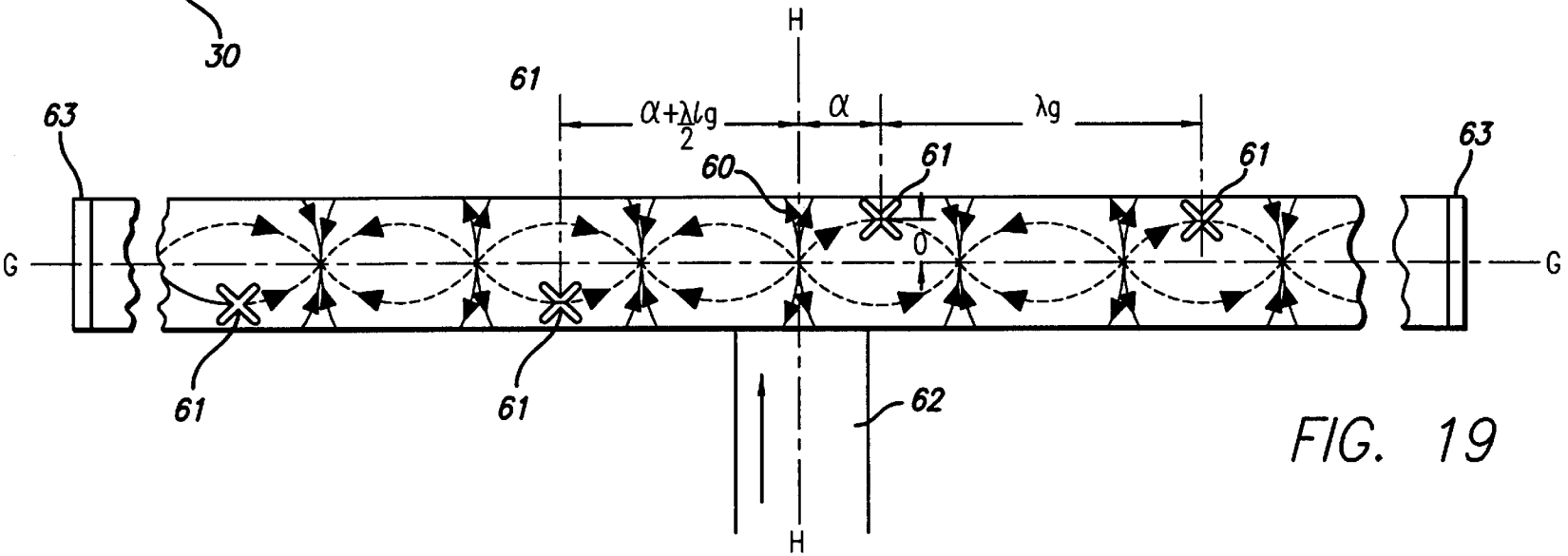
FIG. 19 shows a modification of the slotted waveguide array of FIG. 17 to alleviate beam spreading.

FIG. 19 shows a slotted-waveguide array adapted for shunt feeding, but this can be adapted for series feeding as disclosed in UK 1475111.

FIG. 19 shows the central portion of a length of dielectric loaded slotted rectangular waveguide 60 having radiating-apertures 61 in one broad wall. Each aperture is offset by a distance c from the longitudinal centre line G—G of the broad wall though, unlike the FIG. 17 array, the apertures are not all offset on the same side of the centre line as will be discussed later.

The array is shunt-fed through a feed-waveguide 62 coupling to an aperture in a narrow wall of the waveguide 60 along axis H—H. Power fed in the direction of arrow F enters the slotted-waveguide 60 where it divides equally to right and left of the axis H—H and propagates along the respective waveguide halves which are terminated in respective matched loads 63 to prevent reflections. Each waveguide half-section has the same number of apertures 61. The apertures are shown as being X-shaped slots and the degree of coupling to the waveguide is controllable by adjustment of the slot dimensions.

The mechanism by which circular polarization is obtained is as described in UK 1475111.

Figure 20:
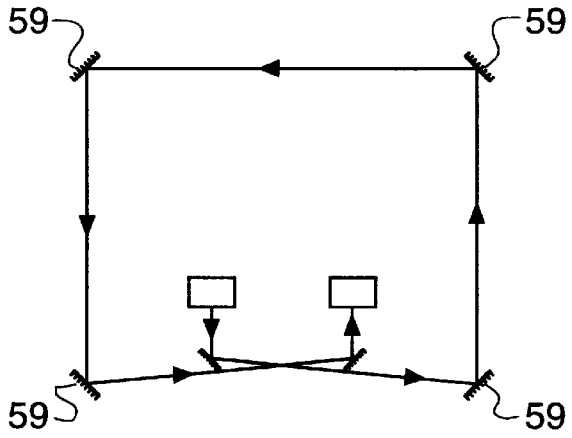
FIG. 20 illustrates a reflector system.

A saving of equipment may be made by having a single fence which turns the corner by way of a passive reflector as shown in FIG. 20. The passive reflector is preferably of a polarisation—twisting kind which changes the polarisation of incident radiation by 90°. With a single reflector this would, of course, require the polarisation of the receiver and transmitter aerial arrays to be orthogonal, e.g. a stack of vertically-polarised elements in one array and a stack of horizontally-polarised elements in the other. The advantage of the 90° twist polarisation in polarisation is that unwanted reflections from, for example, a passing vehicle in the proximity of the fence would not be subject to the 90° polarisation change and would thus not be responded to by the receiver aerial.

One way of avoiding the need for different aerial arrays at the transmitter and receiver is to use a 45° slant polarisation of the same hand in both arrays. Such arrays would of course be cross-polarised if set up to directly look at one another.

Also identical aerial arrays of the same vertical or horizontal polarisation can be used where the number of 90° polarisation changes along the fence is $2n$. An example of this is shown in FIG. 20 in which the boundary of a rectangular area is protected by a single fence without gaps by using six 90° polarisation-twisting reflectors 59.

Figure 9:
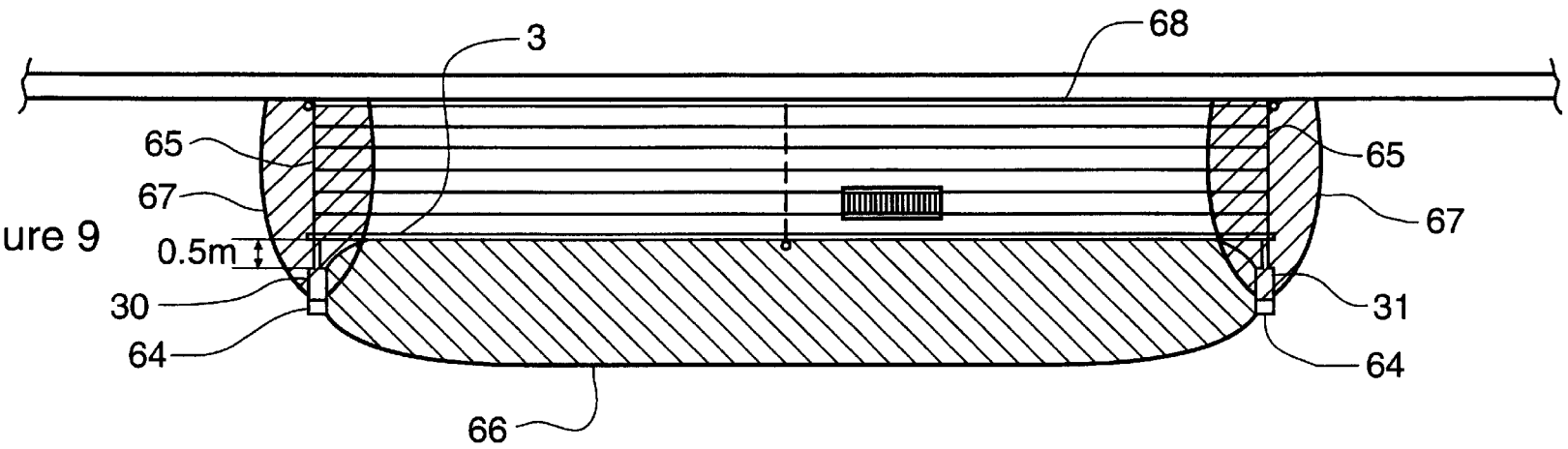
FIGS. 9 and 10 show in plan and elevation one example of the use in the systems of FIGS. 7 and 8 of two different detectors referred to herein as an intrusion sensor and an intruder detector.
Figure 10:
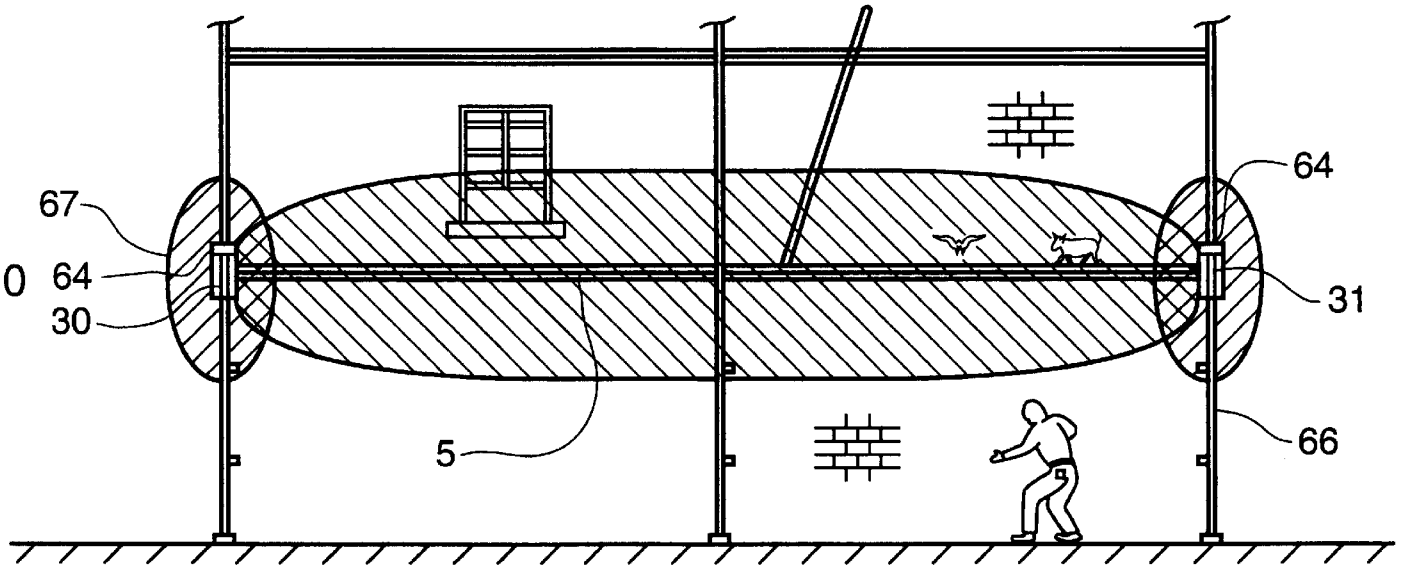
Figure 11:
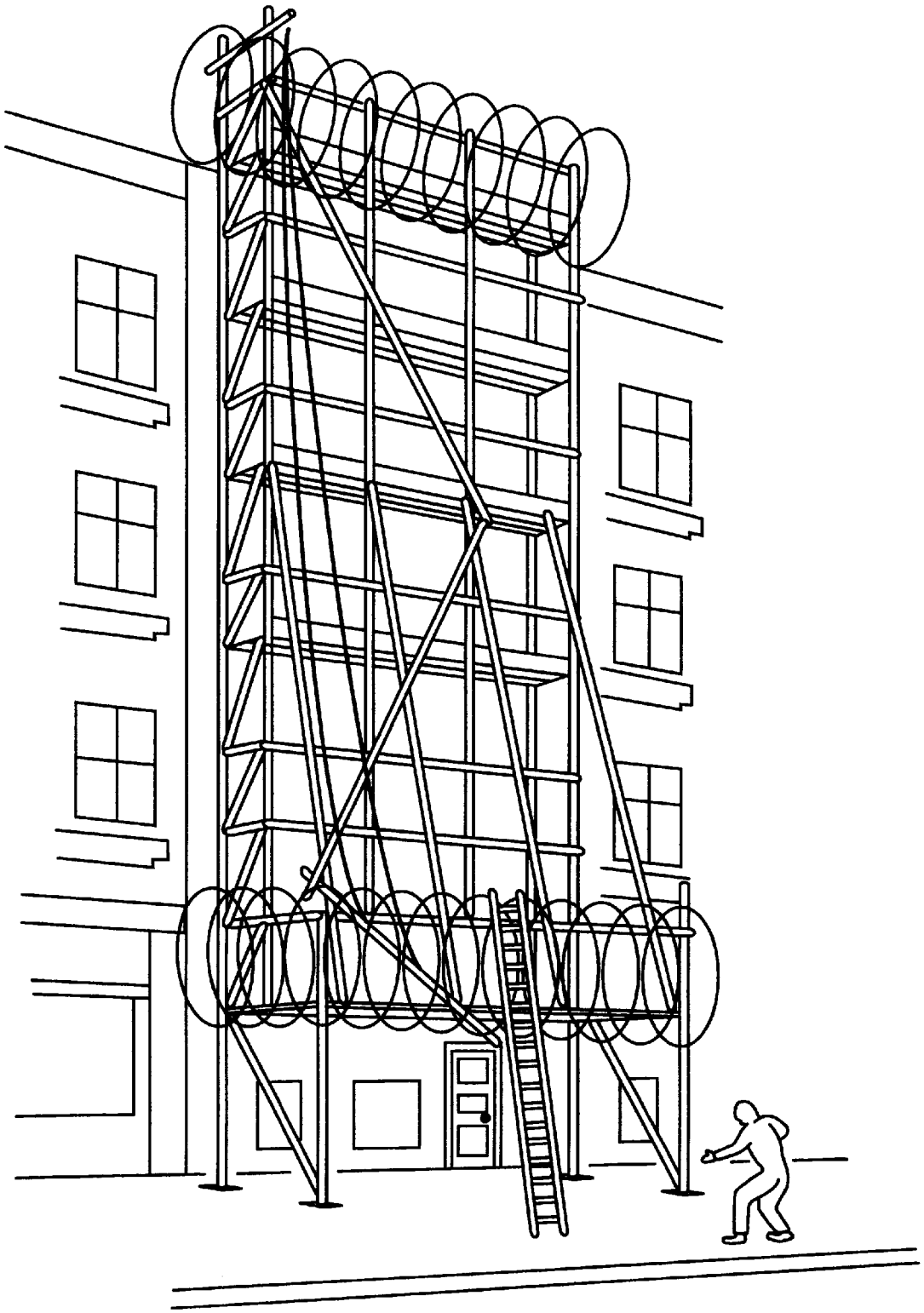
FIG. 11 shows in perspective the use of the detectors of FIGS. 9 and 10 protecting the faces, sides and top level of a boarded scaffold.
Figure 12:
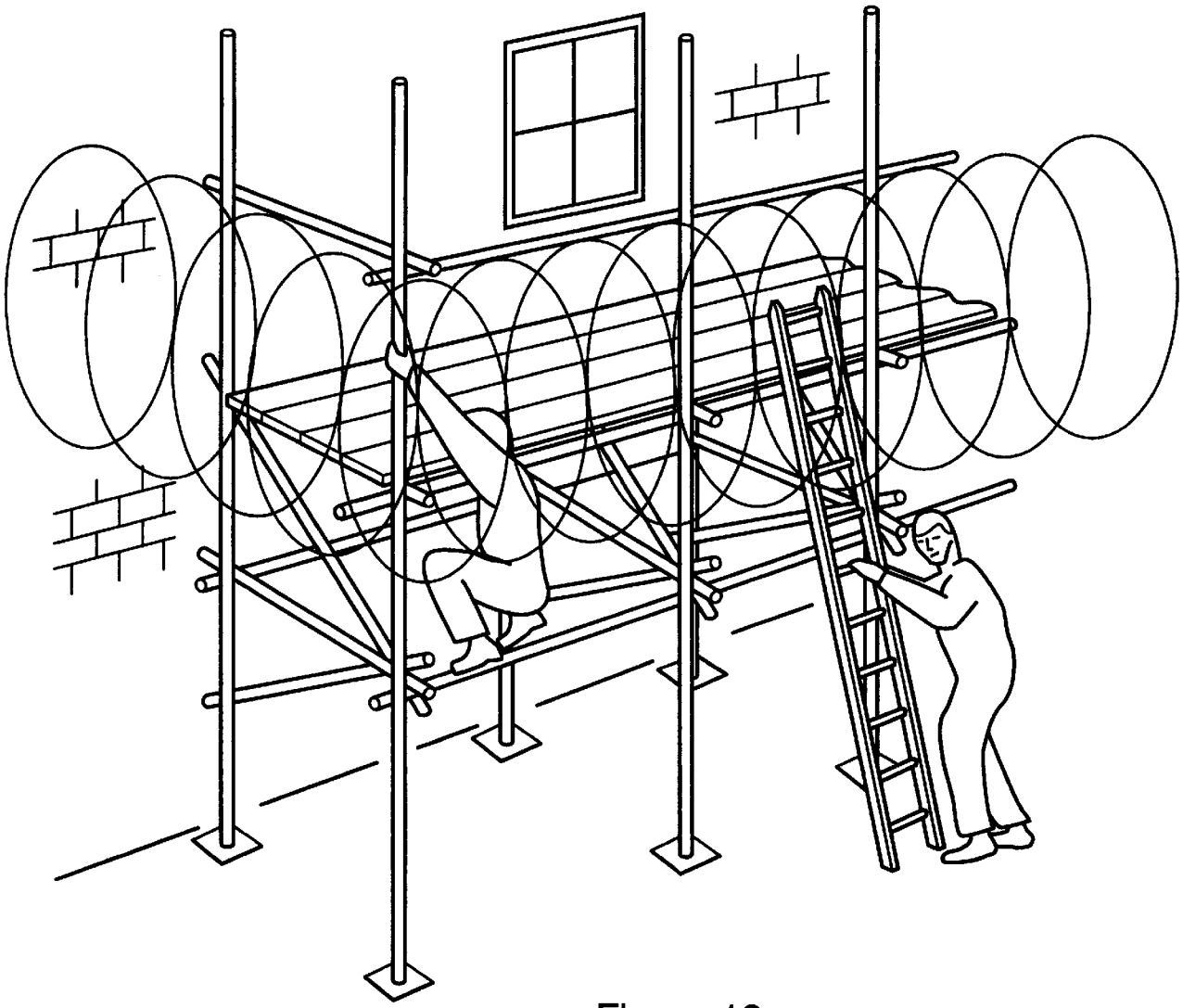
FIG. 12 illustrates the invisible energy field in the system of FIG. 11.
Figure 13:
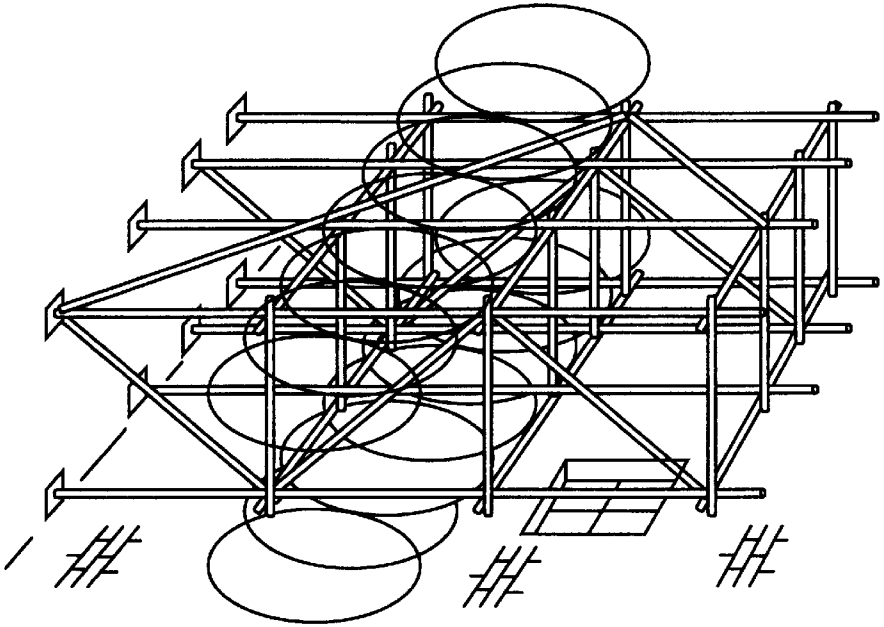
FIGS. 13 and 14 illustrate two alternative configurations and uses of the two detectors covering any of the sides, faces, corners or centre void of unboarded scaffold.
Figure 14:
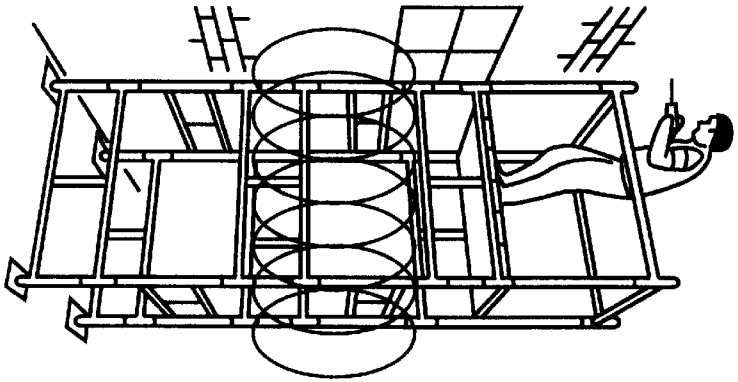

Referring now back to FIGS. 9 and 10, there is illustrated an intruder detector 64 still to be described and the intrusion sensor 30,31 deployed in unison cantilevered approx. 0.50 m (1.6 ft) on a scaffold pole on the outer corner of the scaffold 66. The scaffold is boarded at 5 so that protection is required for the outer face 3 and side faces 65 only at a first level of scaffold. This will detect an intruder climbing up the outer faces or sides to gain initial access to the boarded area and ultimately to the building. The field of detection 67, operational range from 10 m (33 ft) to 150 m (500 ft), is unaffected by birds and small animals and all external scaffold environmental conditions.

The fields of detection 67, operational range 0.5 m (1.6 ft) to 15 m (50 ft), provide coverage to the two vulnerable side faces, the fourth face, 68, abuts the building and climbing access is not available owing to the boards 5.

Figure 22:
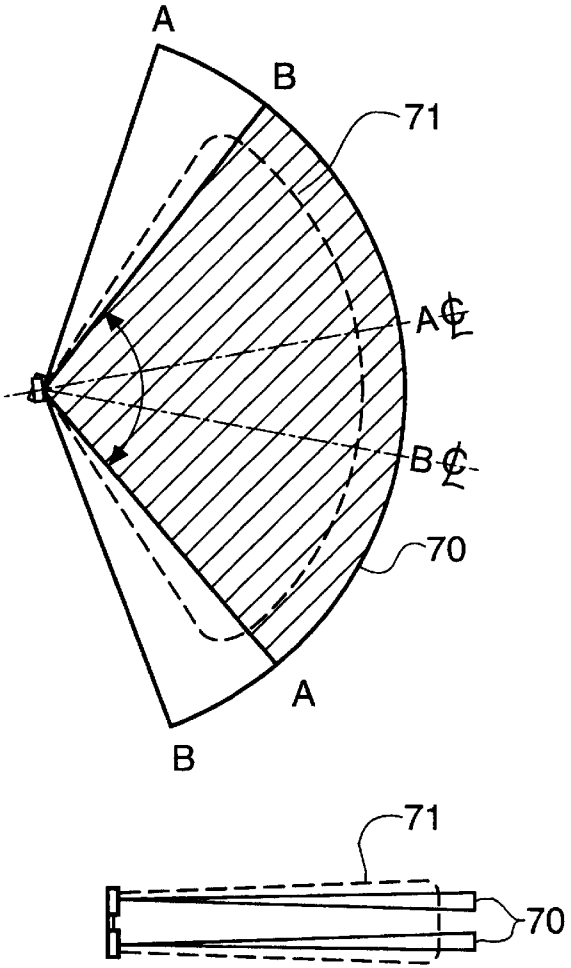
FIGS. 21 and 22 illustrate the detection patterns achieved by an intruder detector for the standard lens pattern and a reduced width array achieved by turning the lower and upper lenses in opposing directions.
Figure 21:
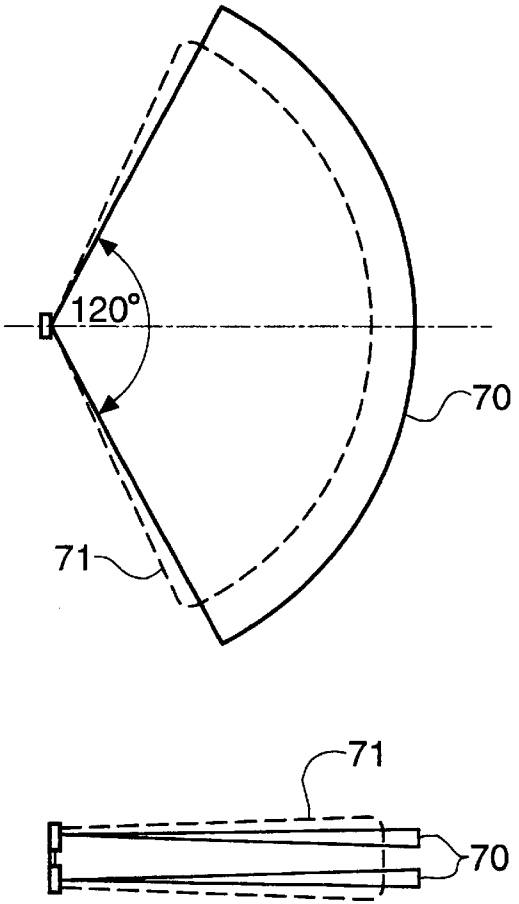

The intruder detector comprises a passive Infrared system and a microwave Doppler system. FIG. 21 illustrates in plan and elevation the infra-red detection pattern 70 and the microwave detection pattern 71 in a detection range from 0.5 m (1.6 ft) to 15 m (50 ft) and FIG. 22 shows a narrowing detection range. The infra-red detection pattern 70 is quickly adjusted to suit a variable narrow width achieved by turning the top and bottom lens in opposing directions, the microwave detection pattern is infinitely adjustable throughout both length and width to suit scaffold variations.

Figure 23:
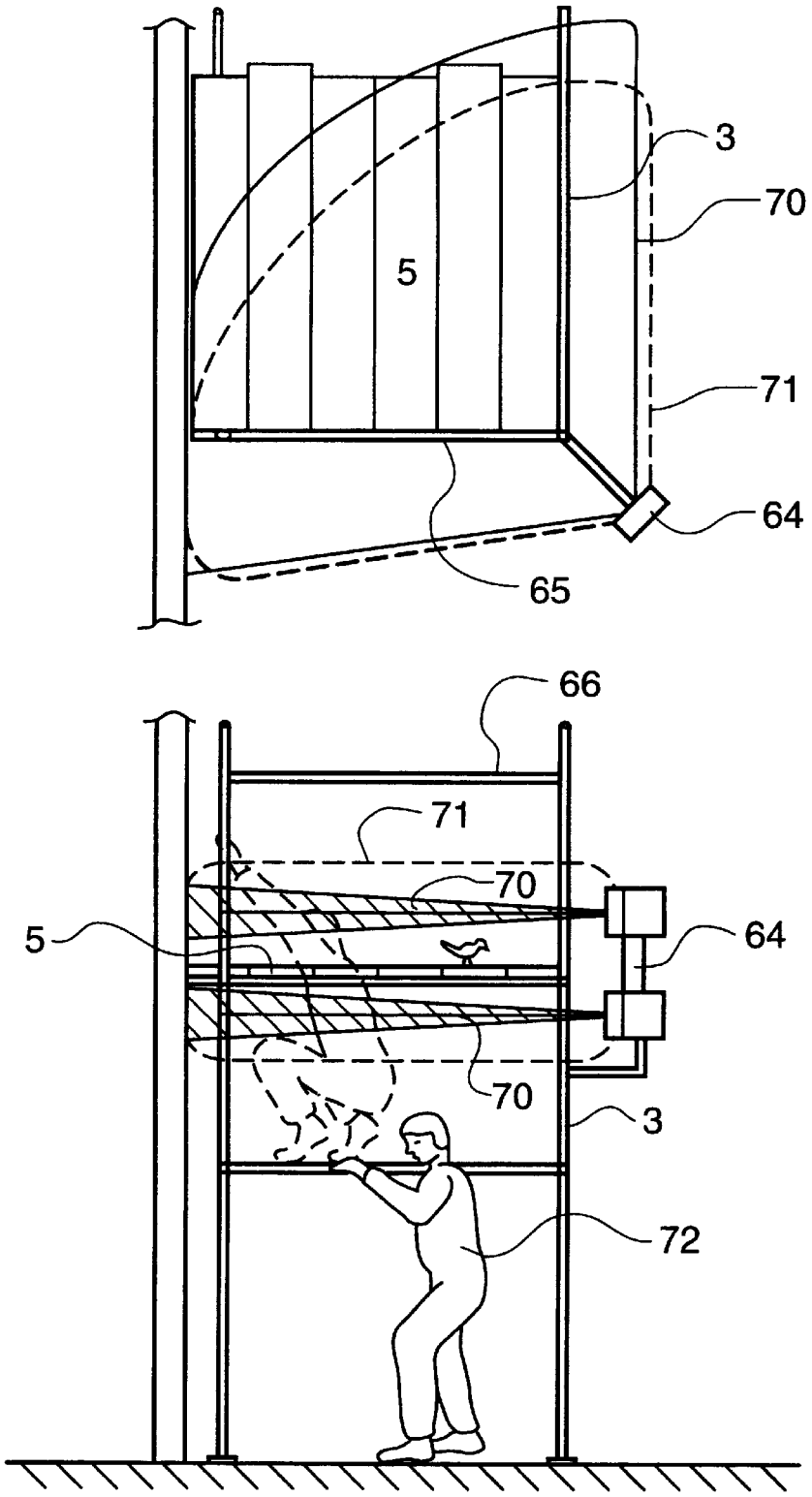
FIG. 23 illustrates an intruder detector deployed individually on a scaffold side face.

FIG. 23 illustrates in plan and elevation the intruder detector 64 mounted on the corner of scaffold 66 and cantilevered out from the scaffold face 3 utilizing the detection pattern. The infra-red detection patterns 70 and the microwave detection pattern 71 cover the scaffold end face 65 detecting an intruder 72 climbing up to or past the boarded area 5. To give a full depth of coverage, the detection patterns above and below the boarded area are extended to provide protection at the front face when used with or without the intrusion sensor. This pattern however is above birds and small animals, standing or moving slowly about on the boards 5. If a bird or small animal should enter the detection pattern it will not alarm as its speed flying or jumping through the pattern will activate the primer trigger preventing a false alarm.

Figure 24:
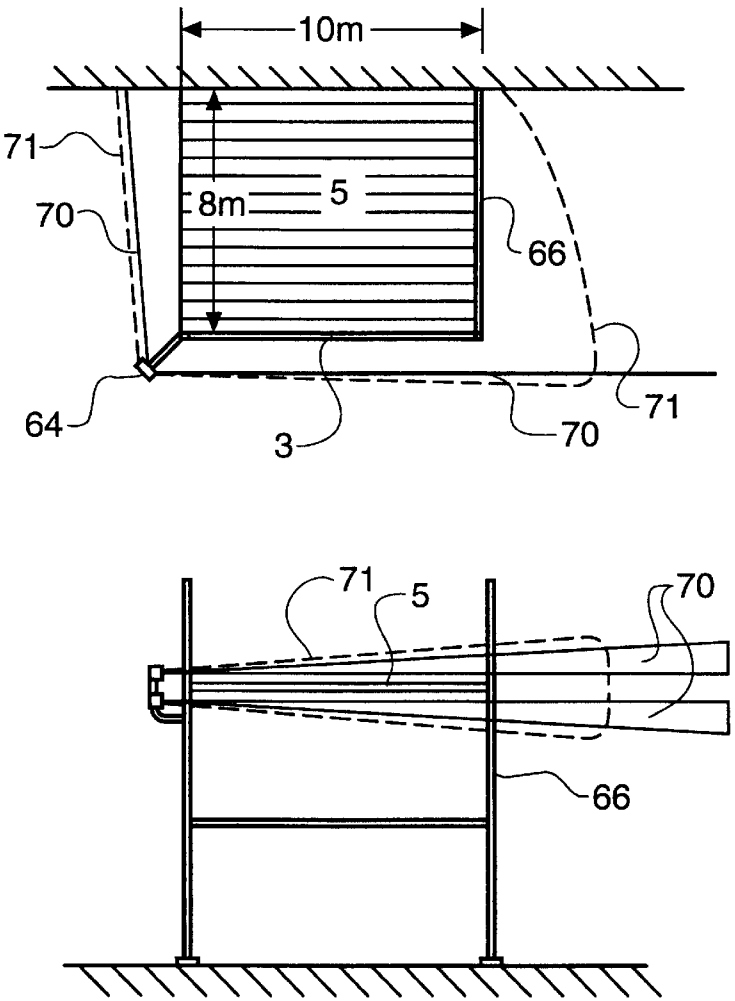
FIG. 24 illustrates intruder detectors deployed individually on a scaffold tower covering front and side faces.

FIG. 24 illustrates in plan and elevation the intruder detectors 64 cantilevered outside of scaffold 66 to give a detection pattern to cover front face 3 at boarded level 5S The microwave detection pattern 71 and the passive infra-red detection patterns 70 are shown to give complete coverage.

Figure 25:
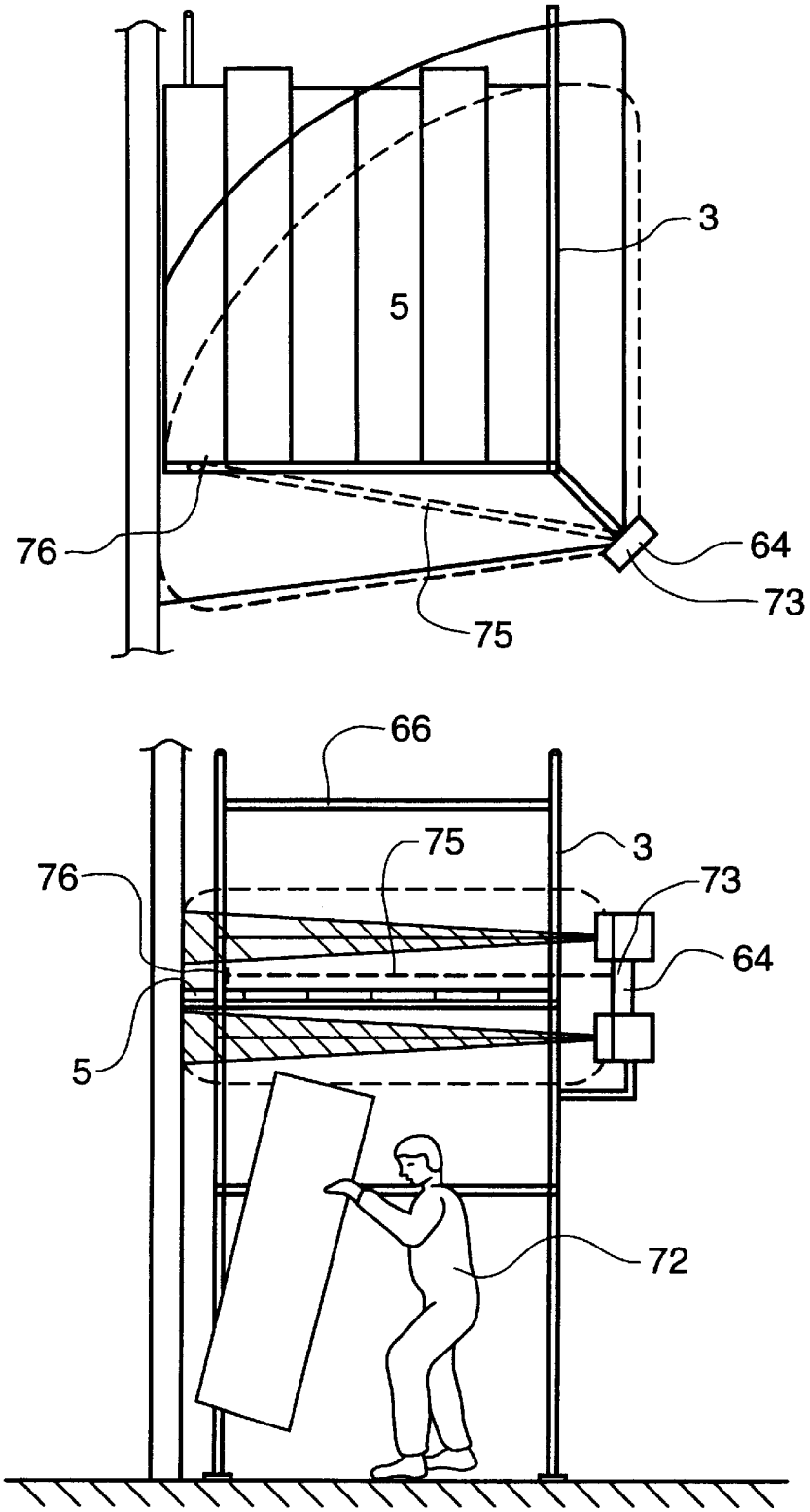
FIG. 25 illustrates an active infra-red beam to prevent masking and misalignment.

As illustrated in FIG. 25 in plan and elevation, to avoid masking and deliberate misalignment of the detector 30 when the system is armed or disarmed, a reflected active infra-red beam transceiver 73 is incorporated within the device. When mounted on the corner of scaffold 66 cantilevered from the front face 3 level with the boarded area 5 the infra-red beam transceiver 73 creates an infra-red beam 75 which is reflected from a reflector 76 back to the transceiver. Should the device be deliberately misaligned or masked by an intruder, the infra-red beam 75 will cease to reflect and an alarm signal will occur.

The active infra-red alignment device can be replaced by an electronic range finder or a laser or light source device.

These devices or the active infra-red alignment devices can be attached to the intrusion sensors if required. Alternatively, the passive infra-red device or devices can be attached to the intrusion sensors.

The intruder detector may be used minus the active infra-red alignment device or any anti sabotage device and/or minus the microwave transceiver where required on low risk security sites.

Figure 26:
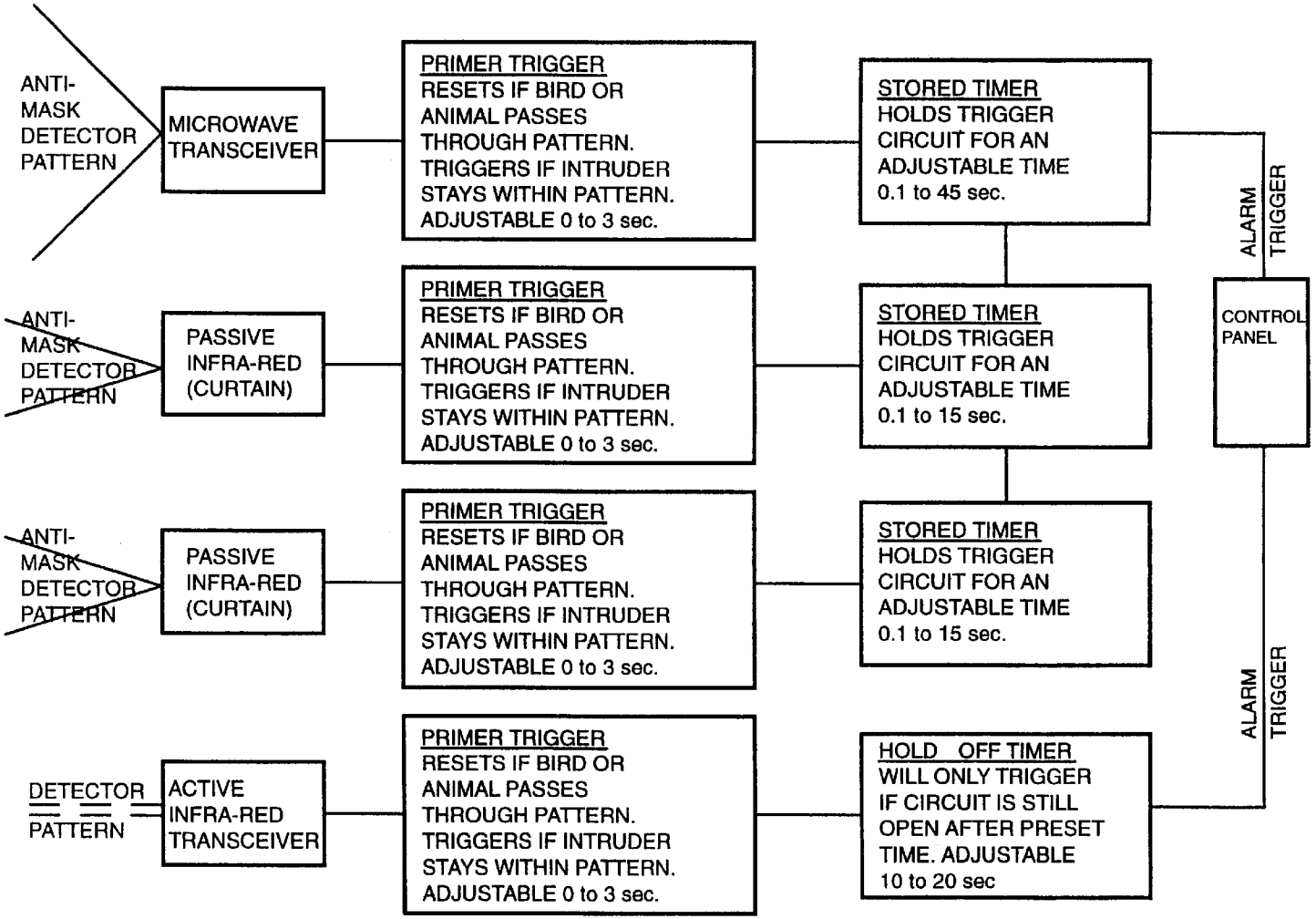
FIG. 26 is a block diagram of a detection circuit of an intruder detector.

Finally FIG. 26 shows the functioning of the intruder detector by means of a block circuit diagram itself explaining the functions concerned. Broadly, a response from three detectors is stored and if all exist within an adjustable time an alarm is given. The time might be adjustable up to 15 seconds for the infrared curtains and higher for the microwave transceiver to remain alert longer to allow both infra-red curtains to be triggered. The adjustable time is variable to suit the type of scaffold covered and to allow for the climbing speed of the intruder. The primer trigger resets if a bird or animal passes through and will only trigger to the stored timer if an intruder stays within the pattern for a pre-set time.

What is claimed is:

1. A security system installed adjacent a vertical surface for detecting the presence of an intruder climbing through a path adjacent the vertical surface, the system having:

a microwave transmitting station comprising:

a transmitting aerial positioned at one end region of said path and having an aerial aperture which has an extent in a direction substantially at right angles to said vertical surface of not less than 0.50 meters (20 inches) to provide a substantially planar microwave beam pattern having an extent at right angles to said path which has a direction a major component of which is horizontal; and a microwave receiving station comprising:

a receiving aerial positioned at an opposite end region of said path and having an aerial aperture which has an extent in a direction substantially at right angles to said vertical surface of not less than 0.50 meters (20 inches) to receive said microwave beam pattern;

a microwave receiver coupled to receive microwave radiation received by said receiving aerial and having means responsive to variation of the received radiation outside a given range to produce a signal to represent the presence of an intruder climbing through said path; and said system including arrangements for directing said microwave beam in a directional pattern substantially elevated above the ground;

whereby intruders climbing through or entering said pattern are detected, and objects moving along the ground do not trigger the security system.

2. A system according to claim 1, the horizontal aperture of each of said transmitter and receiver aerials being 1.5 meters (60 inches).

3. A system according to claim 1, each of said aerials having a half-power beamwidth in the horizontal plane of not more than 2°.

4. A system according to claim 1, said microwave transmitter and receiver and associated aerials having a frequency of operation lying in one of the group consisting of X-band and K-band.

5. A system according to claim 1, each of said transmitter and receiver aerials comprising a horizontal array of radiator elements.

6. A system according to claim 5, each of said transmitter and receiver aerials comprising a slotted waveguide array having slots.

7. A system according to claim 2, each slotted waveguide being filled with a dielectric material and next adjacent slots in the array are spaced at a distance of one wavelength in the waveguide, the dielectric constant of said dielectric material being such that the absolute distance equal to one wavelength in the waveguide provides a spacing between next adjacent slots in the range of one-half to one wavelength in free space.

8. A system according to claim 6, wherein in each slotted waveguide array, each slot thereof is offset from the longitudinal axis of the waveguide wall in which the slot is formed to provide circular polarization.

9. A system according to claim 6, wherein in each slotted waveguide array each slot thereof is offset from the longitudinal axis of the waveguide wall in which the slot is formed to provide circular polarization.

10. A system according to claim 9, each slotted waveguide array having a feed aperture substantially half-way along the waveguide for center-feeding the waveguide array, the slots located on one side of the feed aperture being disposed to one side of the longitudinal axis of the waveguide wall in which they are formed and the slots located on the other side of the feed aperture being disposed to the other side of the longitudinal axis of said waveguide wall.

11. A system according to claim 10, said waveguide being of rectangular form and said feed aperture being located in a narrow wall of the waveguide to provide shunt feed of the slotted waveguide array and the distance between the feed aperture and the first slot to one side of the feed aperture being half a wavelength greater in the dielectric material filled waveguide than the distance between the feed aperture and the first slot to the other side of the feed aperture.

12. A system according to claim 10, said waveguide being of rectangular form and said feed aperture being located a broad wall of the waveguide to provide series feed of the slotted waveguide array and first slot to one side of the feed aperture and the first slot to the other side of the feed aperture being equidistant from the feed aperture.

13. A system according to claim 10, ends of said slotted waveguide being terminated in a matched load to prevent reflections at said waveguide ends.

14. A system according to claim 1 installed on a scaffold with said transmitter and receiver mounted horizontally at either end of the face of the scaffold at a first boarded lift to be monitored for intruder presence.

15. A system according to claim 1, installed on a scaffold adjacent a wall with the transmitter and receiver aerials disposed substantially horizontally, there being one or more further microwave transmitter/receiver pairs disposed in parallel with the first-mentioned transmitter and receiver and between the first-mentioned transmitter and receiver and said wall so as to extend the field of detection, evade voids which can be climbed through, and to reduce the effects of surface reflection from the scaffold faces and any wooden boarding, plastic sheeting and/or netting that may be present.

16. A system according to claim 1 wherein, to protect from false alarms created by birds, melting ice, melting impacted snow and heavy (tropical) rain on the aerials, the aerials have radomes, the faces of which are extended forward by 0.5 m to 1 m from the transmitter and receiver aerials.

17. A system according to claim 16, the facing sides of the radomes being enclosed by a microwave transmissive unit.

18. A system according to claim 1, the aerials mounted adjacent to the vertical surface being mounted above the base of the vertical surface.

19. A system according to claim 18, the aerials mounted adjacent to the vertical surface being mounted at least one-half meter (20 inches) above the base of the vertical surface.

20. A system according to claim 19, said vertical surface being associated with a scaffolding structure having at least a first boarded or unboarded lift, and the aerials being mounted adjacent to the vertical surface at approximately a level defined by the first boarded lift.

21. A system according to claim 1, further comprising:

a passive infrared device providing a set of detection pattern segments defining a curtain which extends along a plane extending with a horizontal component;

a microwave transceiver, secured to the infrared device and having a detection pattern overlapping or at least substantially co-extensive with the infrared curtain; and an active alignment transceiver comprising a transmitter for transmitting an alignment beam and a receiver for detecting a reflected component of the alignment beam, and being physically attached to one of the passive infrared device and the microwave transceiver so that, upon misalignment of the passive infrared device or the microwave transceiver respectively, the alignment beam will cease to reflect back to the receiver of the active alignment transceiver, thus to provide a defense against masking and deliberate misalignment.

22. A system according to claim 21 wherein the vertical surface is the side of the building.

23. A system according to claim 22, wherein all control and communications equipment together form a free-standing portable module or modules to be positioned internally to serve the exterior devices on a scaffold.

24. A system according to claim 1 secured to a passive infrared device providing a set of detection pattern segments defining a curtain extending along a plane having a horizontal component.

25. A system according to claim 1 secured to a microwave transceiver having a detection pattern overlapping or at least substantially coextensive with that of the system.

26. A system according to claim 1 further comprising:

a first and a second passive infrared device, each providing a set of detection pattern segments defining a first curtain and a second curtain respectively which extend along respective spaced-apart planes having a horizontal component; and means responsive to the passive infrared devices and including a storage timer for storing the time at which an intrusion of one of said curtains is sensed by the respective one of said passive infrared devices and being operable to create an alarm condition signal if an intrusion of the other of said curtains is sensed by the respective other one of said passive infrared devices before expiration of a given time interval from said time of the first-mentioned intrusion.

27. A system according to claim 26 wherein the vertical surface is the side of a building.

28. A system according to claim 27 wherein all control and communications equipment together form a free-standing portable module or modules to be positioned internally to serve the exterior devices on a scaffold.

29. A system comprising a microwave transmitter having a microwave aerial, and a microwave receiver having a receiving microwave aerial and which receiver includes a unit responsive to a variation in received signal to provide an alarm signal, each of the aerials comprising an array of radiating elements extending in a horizontal plane and co-acting to provide a substantially horizontal beam pattern having a half-power beam width not greater than 2°, the aerials being mounted spaced apart in the vicinity of a vertical surface so that each element of the receiver array receives radiation components directly from each element of the transmitter array together with vertical-surface-reflected components from at least some of the elements of the transmitter array, the direct and surface-components adding vectorially at the receiver aerial; and said system including arrangements for directing said beam in a horizontal detection pattern substantially elevated above the ground;

whereby intruders climbing through or entering said pattern are detected, and objects moving along the ground do not trigger the security system.

30. An installed intrusion sensing system comprising:

a first and a second passive infrared device, each providing a set of detection pattern segments defining a first curtain and a second curtain respectively which extend along respective spaced-apart planes having horizontal components;

means responsive to the passive infrared devices and including a storage timer for storing the time at which an intrusion of one of said curtains is sensed by the respective one of said passive infrared devices and being operable to create an alarm condition signal if an intrusion of the other of said curtains is sensed by the respective other one of said passive infrared devices before expiration of a given time interval from said time of the first-mentioned intrusion; and said system including arrangements for directing said curtains in a horizontal detection pattern substantially elevated above the ground;

whereby intruders climbing through or entering said pattern are detected, and objects moving along the ground do not trigger the security system.

31. A system according to claim 30, comprising a microwave transceiver secured to the, one of, or both of the infrared devices and having a detection pattern overlapping or at least substantially coextensive with that of at least one of the infrared devices.

32. A system according to claim 30 and comprising means for varying said given time interval.

33. A system according to claim 30, operable to set said given time interval to less than or equal to approximately 15 seconds in duration.

34. A system according to claim 30, the responsive means comprising means operable to create an alarm condition signal if an intrusion of the other of said curtains is sensed by the respective other one of said passive infrared devices before expiration of said given time interval and after expiration of a further given time interval from said stored time of the first-mentioned intrusion.

35. A system according to claim 34 and comprising means for varying said further given time interval.

36. A system according to claim 34, and comprising means operable to set said further given time interval so as not to exceed 3 seconds in duration.

37. A system according to claim 30 and comprising an active alignment transceiver comprising a transmitter for transmitting an alignment beam and a receiver for detecting a reflected component of the alignment beam, and being physically attached to one of the microwave transceiver and passive infrared devices so that, upon misalignment of the passive infrared device or the microwave transceiver to which the alignment device is attached, the alignment beam will cease to reflect back to the receiver of the alignment device, thus to provide a defense against masking and deliberate misalignment.

38. An intrusion sensing system comprising:

a passive infrared device providing a set of detection pattern segments defining a curtain which extends along a plane extending with a horizontal component;

a microwave transceiver, secured to the infrared device and having a detection pattern overlapping or at least substantially co-extensive with the infrared curtain;

an active alignment transceiver comprising a transmitter for transmitting an alignment beam and a receiver for detecting a reflected component of the alignment beam, and being physically attached to one of the passive infrared device and the microwave transceiver so that, upon misalignment of the passive infrared device or the microwave transceiver respectively, the alignment beam will cease to reflect back to the receiver of the active alignment transceiver, thus to provide a defense against masking and deliberate misalignment; and said system including arrangements for directing said curtain in a horizontal detection pattern substantially elevated above the ground;

whereby intruders climbing through or entering said pattern are detected, and objects moving along the ground do not trigger the security system.

39. A system according to claim 38 and comprising a reflector for reflecting the alignment beam back to the alignment device and positioned in the infrared or microwave detection patterns remove from the alignment device.

40. A system according to claim 38, the transmitter of the alignment device being an infrared beam transmitter.

41. A system according to claim 38 and comprising a test circuit operable to perform a test circuit operable to perform a test of the alignment of the system by means of the alignment device, both when the system is in a disarmed state and when the system is in an armed state.

42. A system according to claim 41, the test circuit having means for testing the alignment of the system when the system is to be armed and to allow arming of the system only if the test determines that the system is aligned.

43. A system according to claim 41, the test circuit being arranged to remain functional after the system has been armed and set to an armed state.

44. A system according to claim 41, and comprising means operable such that, when the system is in an armed state, masking or misalignment of the alignment beam for more than 10 to 20 seconds will create a full alarm condition.

45. A system according to claim 38, wherein the microwave transceiver, the or each passive infrared device, and the active alignment transceiver are all incorporated into one apparatus and enclosed in a common housing.

46. A system according to claim 45 wherein the housing is protected by an anti-tamper circuit.

47. An intrusion sensing system installed adjacent a vertical surface for detecting the presence of an intruder climbing through a path adjacent the vertical surface, the system comprising:

at least one detection device having a transmitter and a receiver;

said detection device providing a detection pattern which extends along horizontal components and includes said path adjacent said vertical surface; and said system including arrangements for elevating said detection pattern substantially above the ground;

whereby intruders climbing through or entering said pattern are detected, and objects moving along the ground do not trigger the sensing system.

* * * * *